US010077930B2

(12) United States Patent
Tamaki et al.

(10) Patent No.: US 10,077,930 B2
(45) Date of Patent: Sep. 18, 2018

(54) AIR-CONDITIONING APPARATUS AND AIR-CONDITIONING SYSTEM

(71) Applicant: Mitsubishi Electric Corporation, Tokyo (JP)

(72) Inventors: Shogo Tamaki, Tokyo (JP); Kazuyoshi Shinozaki, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/108,849

(22) PCT Filed: Nov. 12, 2014

(86) PCT No.: PCT/JP2014/005692

§ 371 (c)(1),
(2) Date: Jun. 29, 2016

(87) PCT Pub. No.: WO2015/114704

PCT Pub. Date: Aug. 6, 2015

(65) Prior Publication Data

US 2016/0327320 A1 Nov. 10, 2016

Related U.S. Application Data

(63) Continuation of application No. 14/168,050, filed on Jan. 30, 2014, now Pat. No. 9,823,003.

(51) Int. Cl.
*F25B 49/02* (2006.01)
*F25B 49/00* (2006.01)
(Continued)

(52) U.S. Cl.
CPC ..... *F25B 49/02* (2013.01); *F24F 11/83* (2018.01); *F25B 13/00* (2013.01); *F25B 49/00* (2013.01);
(Continued)

(58) Field of Classification Search
CPC ..... F25B 49/02; F25B 13/00; F25B 49/00; F25B 2313/0233; F25B 2600/2519;
(Continued)

(56) References Cited

U.S. PATENT DOCUMENTS 5,974,813 A * 11/1999 Jeong ..... F24F 11/0086 62/127
7,621,138 B2 * 11/2009 Lee ..... F24F 11/006 236/1 B
(Continued)

FOREIGN PATENT DOCUMENTS

JP H08-075226 A 3/1996
JP H09-021573 A 1/1997
(Continued)

OTHER PUBLICATIONS

International Search Report of the International Searching Authority dated Jul. 3, 2015 for the corresponding international application No. PCT/JP2014/005692.

*Primary Examiner* — Marc Norman
*Assistant Examiner* — Nelson Nieves
(74) *Attorney, Agent, or Firm* — Posz Law Group, PLC

(57) ABSTRACT

An air-conditioning apparatus and an air-conditioning system including a first unit including a compressor and a first heat exchanger, and a plurality of second units that each include a second heat exchanger. Each of the plurality of second units connect to the first unit via a plurality of branched pipes and a plurality of valves. The air-conditioning apparatus and air-conditioning system also include a storage unit that stores connection information indicating a relationship of connection between the plurality of second units and the plurality of branched pipes, and a control unit that detects whether the connection information includes a closed path pipe.

19 Claims, 11 Drawing Sheets

(51) Int. Cl.

| | |
|---|---|
| ***F24F 11/83*** | (2018.01) |
| ***F25B 13/00*** | (2006.01) |
| *F24F 11/63* | (2018.01) |
| *F24F 11/84* | (2018.01) |

(52) U.S. Cl.
CPC ..... *F24F 11/63* (2018.01); *F24F 11/84* (2018.01); *F25B 2313/0233* (2013.01); *F25B 2600/2519* (2013.01)

(58) Field of Classification Search
CPC ..... F25B 41/003; F25B 2313/006; F25B 2313/007; F25B 2500/04; F24F 11/008; F24F 2011/0082; F24F 2011/0061; F24F 1/32; F24F 3/065; F24F 2221/32
See application file for complete search history.

(56) References Cited

U.S. PATENT DOCUMENTS

2009/0049850 A1* 2/2009 Kim ..... F24F 1/26 62/159
2013/0305758 A1 11/2013 Matsui

FOREIGN PATENT DOCUMENTS

JP 2002-013777 A 1/2002
JP 2011-149622 A 8/2011

* cited by examiner

[FIG. 1]
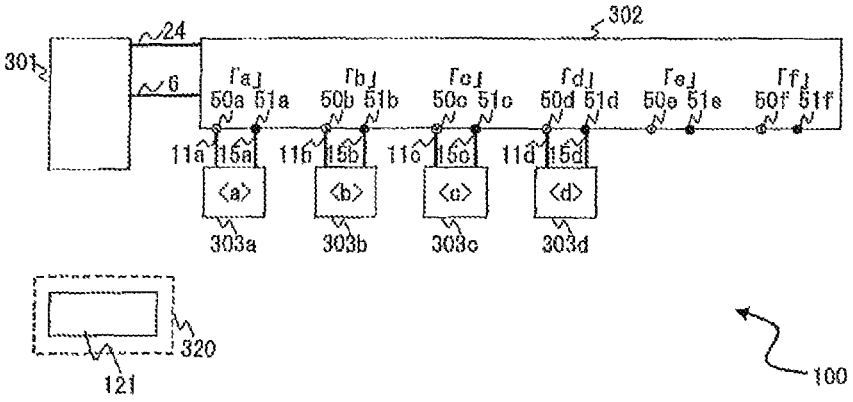

[FIG. 2]
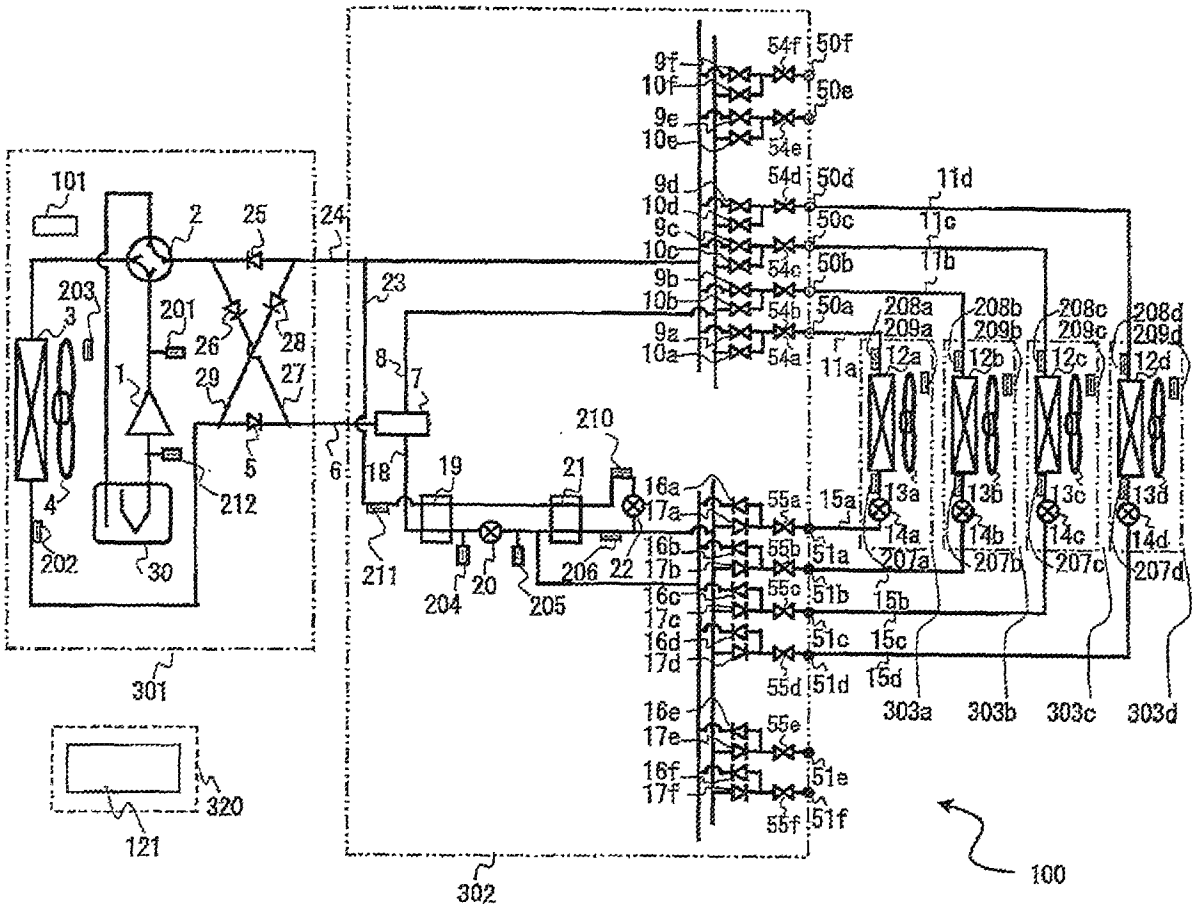

[FIG. 3]
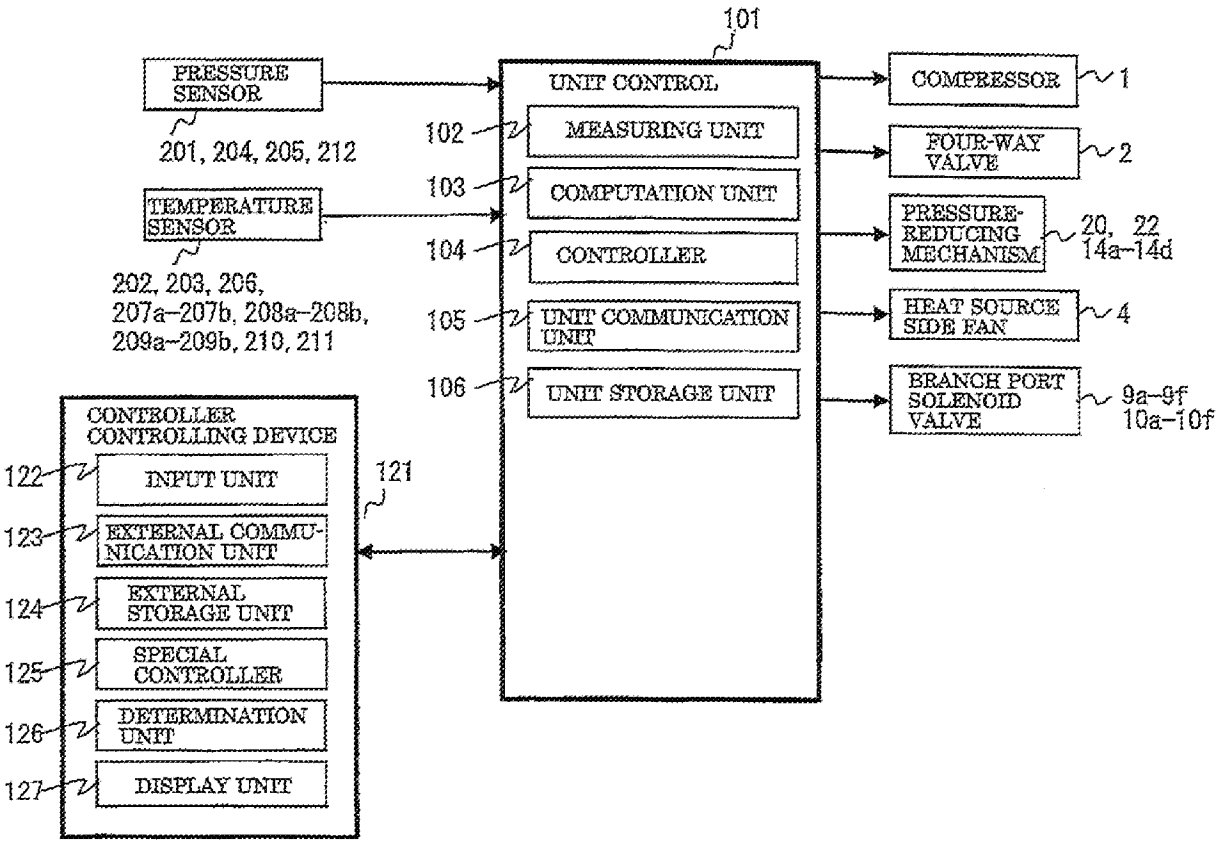

[FIG. 4]
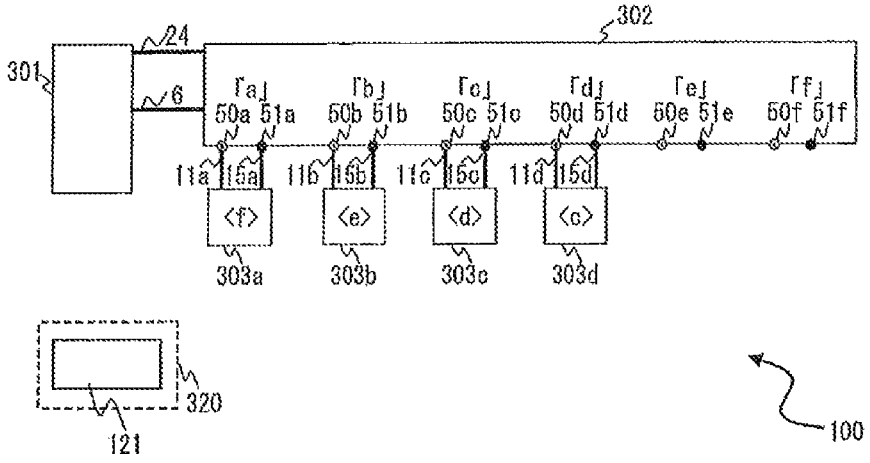

[FIG. 5]
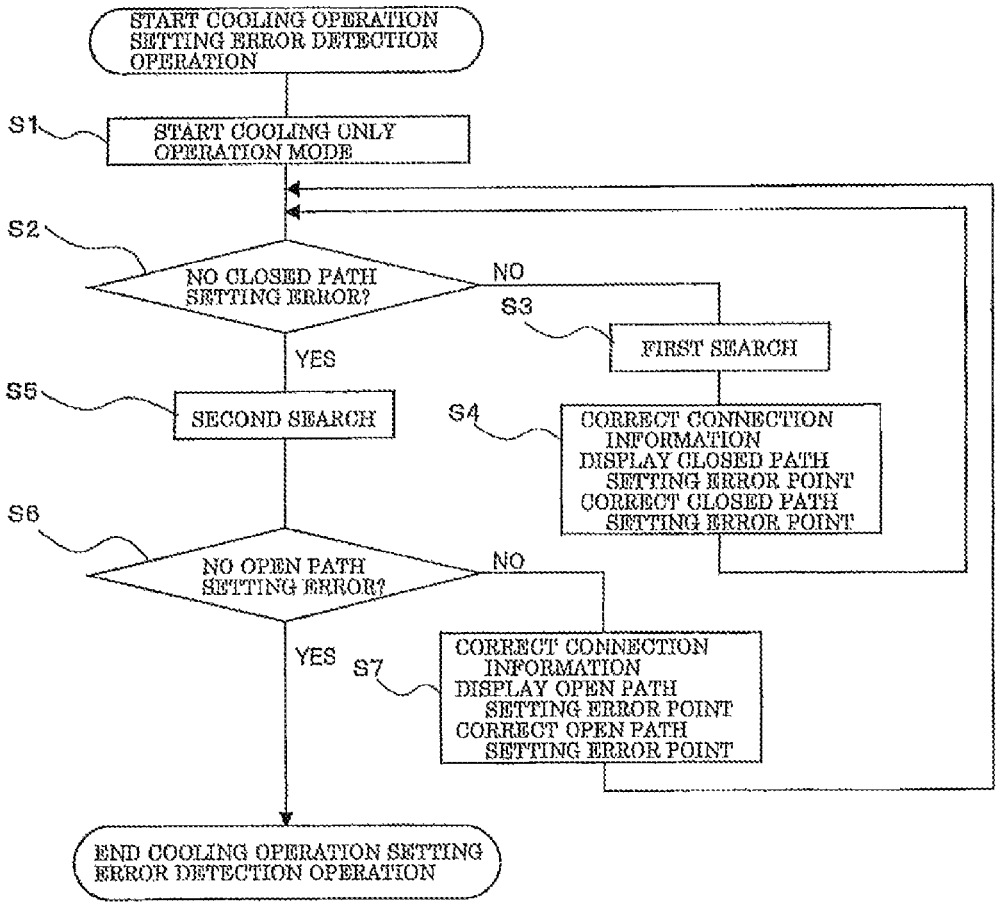

[FIG. 6]

| USE SIDE UNIT | | 303a | 303b | 303c | 303d |
|---|---|---|---|---|---|
| CONNECTED PIPE | | 「a」 | 「b」 | 「c」 | 「d」 |
| SETTING PIPE | ON START OF DETECTION OPERATION | <f> | <e> | <d> | <c> |
| | AFTER CORRECTION OF FIRST SEARCH | <a> | <b> | <d> | <c> |
| | AFTER CORRECTION OF SECOND SEARCH | <a> | <b> | <c> | <d> |

[FIG. 7]
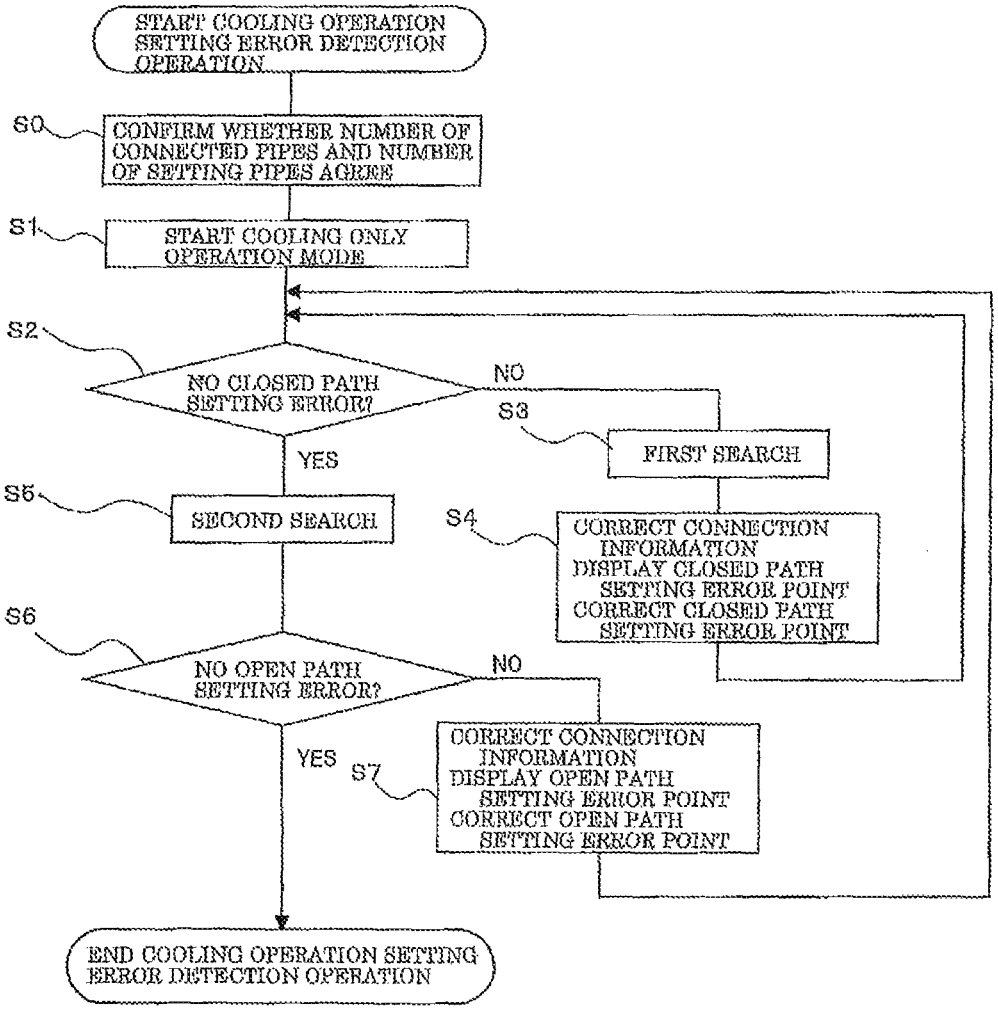

[FIG. 8]

| USE SIDE UNIT | | 303a | 303b | 303c | 303d | 303e |
|---|---|---|---|---|---|---|
| CONNECTED PIPE | | 「a」 | 「b」 | 「c」 | 「d」 | 「e」 |
| SETTING PIPE | ON START OF DETECTION OPERATION | <f> | <e> | <d> | <c> | — |
| | AFTER CORRECTION OF FIRST SEARCH | <a> | <b> | <d> | <c> | — |
| | AFTER CORRECTION OF SECOND SEARCH | <a> | <b> | <c> | <d> | <e> |

[FIG. 9]

| USE SIDE UNIT | | 303a | 303b | 303c | 303d | — |
|---|---|---|---|---|---|---|
| CONNECTED PIPE | | 「a」 | 「b」 | 「c」 | 「d」 | — |
| SETTING PIPE | ON START OF DETECTION OPERATION | <f> | <e> | <d> | <c> | <b> |
| | AFTER CORRECTION OF FIRST SEARCH | <a> | <e> | <d> | <c> | <b> |
| | AFTER CORRECTION OF SECOND SEARCH | <a> | <b> | <c> | <d> | — |

[FIG. 10]
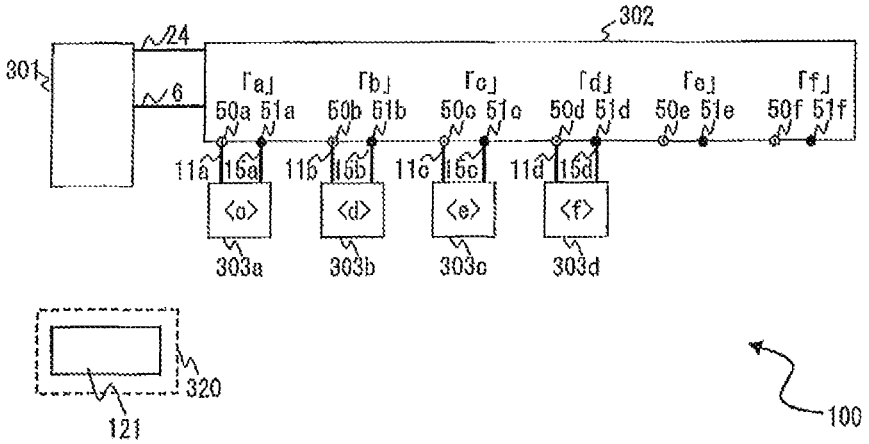
[FIG. 11]
| USE SIDE UNIT | | 303a | 303b | 303c | 303d |
|---|---|---|---|---|---|
| CONNECTED PIPE | | 「a」 | 「b」 | 「c」 | 「d」 |
| SETTING PIPE | ON START OF DETECTION OPERATION | <c> | <d> | <e> | <f> |
| | AFTER CORRECTION OF FIRST SEARCH (FIRST TIME) | <a> | <b> | <c> | <f> |
| | AFTER CORRECTION OF FIRST SEARCH (SECOND TIME) | <a> | <b> | <c> | <d> |

[FIG. 12]
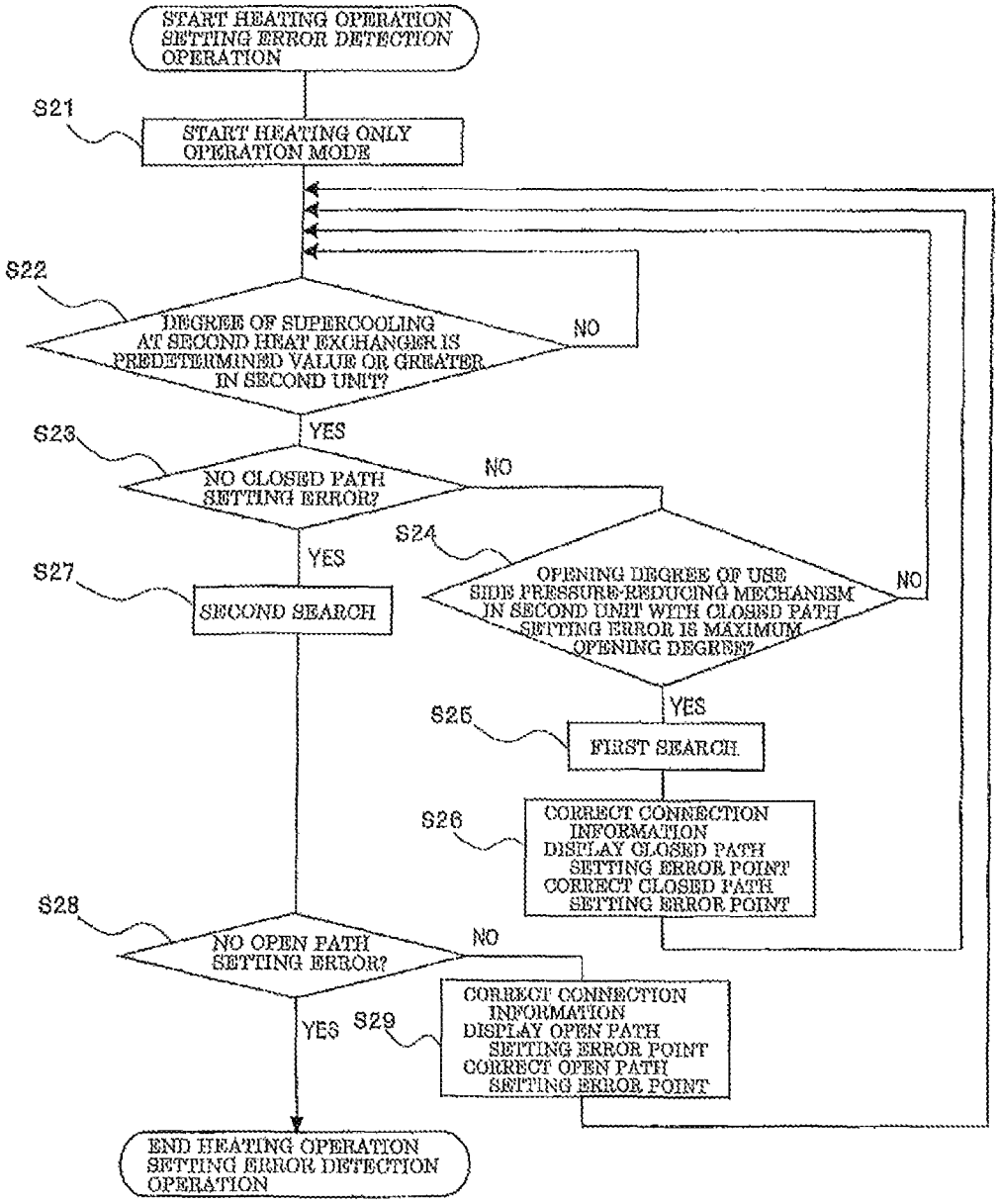

[FIG. 13]
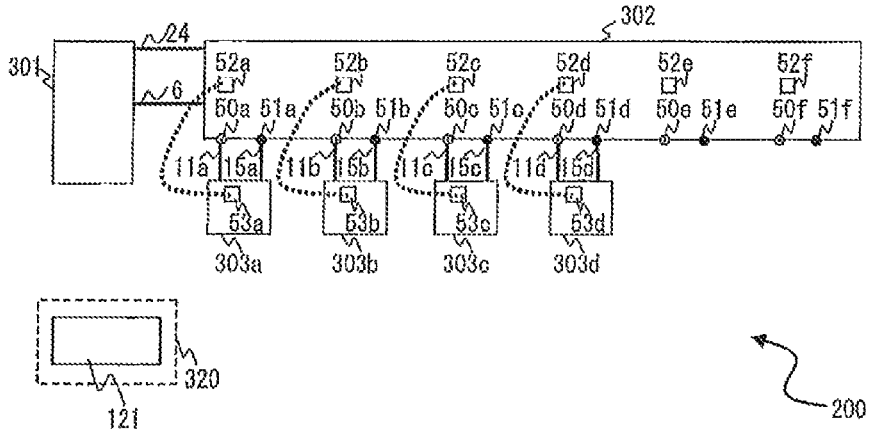

AIR-CONDITIONING APPARATUS AND AIR-CONDITIONING SYSTEM

CROSS REFERENCE TO RELATED APPLICATIONS

This application is a U.S. national stage application of PCT/JP2014/005692 filed on Nov. 12, 2014, which is a continuation of and claims priority to U.S. patent application Ser. No. 14/168,050 filed on Jan. 30, 2014, now U.S. Pat. No. 9,823,003, the contents of which are incorporated herein by reference.

TECHNICAL FIELD

The present invention relates to an air-conditioning apparatus of steam compression type in which a first unit (disposed at a heat source side) and a plurality of second units (disposed at a use side) are connected via a branching unit. In particular, the present invention relates to an air-conditioning apparatus that can appropriately determine whether setting of connection information indicating relations of connections between the second unit and a plurality of branched pipes is correct and an air-conditioning system including the same.

BACKGROUND

In an air-conditioning apparatus configured by connecting a plurality of second units to at least one or more first units by pipes, connection information indicating the relation of connection between the second units and the branched pipes is usually set manually by workers upon the construction work on the installation location of the apparatus. Since the connection of pipes for the second units and the setting of connection information are independently performed, construction errors may occur in which the correspondence relation between a pipe to which the second unit is connected (connected pipe) and a pipe set as connection information (setting pipe) do not agree to one another (there is an incorrect correspondence relation).

Where there is an incorrect correspondence relation, it is not possible to normally perform indoor temperature conditioning in the second units, and customer complaints may occur after the product is delivered to the user.

Therefore, technologies have conventionally been developed that automatically detect disagreements in the correspondence relations between the connected pipes and the setting pipes (see, for example, Patent Literatures 1 and 2).

In the air-conditioning apparatus described in Patent Literature 1, it is determined that an indoor heat exchanger is functioning as a condenser where the refrigerant temperature within the indoor heat exchanger of an indoor unit is higher than the suction air temperature, and it is determined that the indoor heat exchanger is functioning as an evaporator where the refrigerant temperature is lower than the suction air temperature. The apparatus is configured such that, where the indoor unit is switched to a cooling or a heating operation, it is determined in the indoor unit whether its connection with the corresponding branching valve unit via a signal line is appropriate by determining which of a condenser and an evaporator the indoor heat exchanger of the indoor unit is functioning as.

Further, the air-conditioning apparatus disclosed in Patent Literature 2 is such that in a splitting unit in which refrigerant splitting for the indoor units is adjusted, by repeating multiple times an operation in which a substantially half of solenoid valves being open in the splitting unit is closed on the test run, and a substantially half of solenoid valves having been closed is opened, to thereby accurately detect correspondence relations between the indoor units and the solenoid valves within the splitting unit in a short time so that it is possible to accurately perform cooling and heating operations of a desired indoor unit.

PATENT LITERATURE

[Patent Literature 1] Japanese Patent Laid-Open Application Publication No. 2002-013777 (see, for example, FIG. 2)

[Patent Literature 2] Japanese Patent Laid-Open Application Publication No. H09-21573 (see, for example, FIG. 3)

However, these conventional techniques do not give consideration to presence or absence of a closed path setting error in which a pipe to which no second unit is connected is included in the connection information (in other words, such a closed path is erroneously set as a setting pipe). Therefore, where a closed path setting error is present and the opening/closing valve of a connected pipe is forcibly switched, the number of second units serving as evaporators or condensers becomes extremely small, producing a possibility that the apparatus operation is stooped during operation due to control for protection triggered when the refrigerant pressure becomes extremely low or high. Further, since there is always a second unit for which the opening/closing valve is closed, the refrigerant temperature in the second unit does not change even if the opening/closing valve is switched over, and it is not possible to appropriately determine whether the connected pipe and the setting pipe agree to one another.

SUMMARY

The present invention is made to overcome the above-stated problems, and an object thereof is to obtain an air-conditioning apparatus and an air-conditioning system in which the closed path setting error is considered, and it is possible to appropriately determine whether the connected pipes and the setting pipes agree to one another without stop in the midway of the operation even in the case where the closed path setting error is present.

The air-conditioning apparatus according to the present invention comprises: a first unit including a compressor and a first heat exchanger; a plurality of second units each including a second heat exchanger and each being connected to the first unit via a plurality of branched pipes; a plurality of valves configured to open to permit refrigerant flows and close to not permit the refrigerant flows; a storage unit configured to store connection information indicating a relationship of connection between the plurality of second units and the plurality of pipes; a closed path pipe that is any of the plurality of branched pipes to which no second unit is connected, and a control unit configured to detect whether the closed path pipe is included in the connection information.

According to the air-conditioning apparatus of the present invention, since presence or absence of the closed path setting error is determined, it is possible to find a second unit with a closed path setting error in an early stage and an appropriate measure can be taken.

BRIEF DESCRIPTION OF DRAWINGS

FIG. 1 is a schematic diagram of the apparatus configuration of the air-conditioning apparatus 100 in Embodiment 1 of the present invention.

FIG. 2 is a refrigerant circuit diagram of the air-conditioning apparatus 100 of Embodiment 1 of the present invention.

FIG. 3 is a block diagram of the unit control unit 101 of the air-conditioning apparatus 100 of Embodiment 1 of the present invention.

FIG. 4 shows example 1 of the setting error of a setting pipe of the air-conditioning apparatus 100 of Embodiment 1 of the present invention.

FIG. 5 is a first flowchart of a cooling operation setting error detection operation of the air-conditioning apparatus 100 of Embodiment 1 of the present invention.

FIG. 6 is a table showing the flow of the correction of the setting error of the setting pipe in example 1 of the air-conditioning apparatus 100 of Embodiment 1 of the present invention.

FIG. 7 is a second flowchart of a cooling operation setting error detection operation of the air-conditioning apparatus 100 of Embodiment 1 of the present invention.

FIG. 8 is a table showing the flow of the correction of the setting error of the setting pipe in example 2 of the air-conditioning apparatus 100 of Embodiment 1 of the present invention.

FIG. 9 is a table showing the flow of the correction of the setting error of the setting pipe in example 3 of the air-conditioning apparatus 100 of Embodiment 1 of the present invention.

FIG. 10 shows example 4 of the setting error of a setting pipe of the air-conditioning apparatus 100 of Embodiment 1 of the present invention.

FIG. 11 is a table showing the flow of the correction of the connection information in the case of the setting error of the setting pipe in example 4 of the air-conditioning apparatus 100 of Embodiment 1 of the present invention.

FIG. 12 is a first flowchart of a heating operation setting error detection operation of the air-conditioning apparatus 100 of Embodiment 1 of the present invention.

FIG. 13 is a diagram showing the apparatus configuration and wiring of the transmission line of the air-conditioning apparatus 200 of Embodiment 2 of the present invention.

DETAILED DESCRIPTION

Hereafter, embodiments of the present invention will be described with reference to the drawings. The present invention is not limited to the embodiments described hereafter. Further, there may be cases where the relationships among sizes or scales of the constituent elements may be different from actual ones in the drawings mentioned below.

Embodiment 1

Configuration

FIG. 1 is a schematic diagram of apparatus configuration of the air-conditioning apparatus 100 of Embodiment 1 of the present invention.

This air-conditioning apparatus 100 is installed in a large-scale trade establishment or an office building, etc., and can perform cooling and heating concurrent operation by individually processing a cooling instruction (cooling ON/OFF) or a heating instruction (heating ON/OFF) selected in each of the second units (use side units) 303*a*-303*d* and perform a refrigeration cycle operation of a steam compression type.

In the air-conditioning apparatus 100, the first unit (heat source side unit) 301 and the branching unit 302 are connected by a high-pressure pipe 6 and a low-pressure pipe 24 that are refrigerant pipes. Further, the second unit 303*a* is connected to the branching unit 302 via a gas pipe 11*a* and a liquid pipe 15*a*, which are refrigerant piping of the branching unit 302 connected to the branching port 50*a*, and the branching port 51*a* for the plurality of branched pipes of the branching unit 302.

The second units 303*b*, 303*c*, 303*d*, similarly to the second unit 303*a*, are connected to the branching unit 302 via gas pipes 11*b*, 11*c*, 11*d* and liquid pipes 15*b*, 15*c*, 15*d*, which are refrigerant pipes connected to the branching port 50*b*, 50*c*, 50*d* and the branching ports 51*b*, 51*c*, 51*d* for the plurality of branched pipes, of the branching unit 302.

The refrigerant used in the air-conditioning apparatus 100 is not limited in particular. For example, natural refrigerant such as R410A, R32, HFO-1234yf, or hydrocarbon may be employed. Further, an external controller 320 comprising a note PC or a tablet-type terminal PC is provided. A below-stated controller controlling device 121 is provided in the external controller 320.

In the branching unit 302, the branching port 50*a* and the branching port 51*a* of the pipes are correctively referred to as a connected pipe "a". This manner of reference similarly applies to other branching ports of the pipes. The branching port 50*b* and branching port 51*b*, the branching port 50*c* and branching port 51*c*, the branching port 50*d* and the branching port 51*d*, the branching port 50*e* and branching port 51*e*, the branching port 50*f* and branching port 51*f*, are referred respectively to as piping, or (connected) pipes, "b", "c", "d", "e" and "f".

For the second units 303*a*-303*d*, in order to detect which of the connected pipes each of the second units is connected, "setting pipe", which is information showing the relationship of connection between each of the connected pipes second unit and each of the second units, is set upon the installation construction of the apparatus. The setting pipe is stored in an external storage unit (storage means) that will be described later. The connection information is stored in a unit storage unit that will be described below. Since the second unit 303*a* is connected to the pipe "a", the setting pipe set in the connection information is set as <a>. The second units 303*b*, 303*c*, 303*d* are similarly connected respectively to (connected) pipes "b", "c" and "d", and therefore setting pipes are referred respectively to as <b>, <c> and <d>.

In Embodiment 1, each of the branching ports 50*a*-50*f* for a plurality of branched pipes is provided with corresponding one of stop valves 54*a*-54*f* manually opened and closed by a worker upon the construction work, and similarly, each of the branching ports 51*a*-51*f* for a plurality of branched pipes is provided with, corresponding one of stop valves 55*a*-55*f* manually opened and closed by a worker upon construction work. The stop valves 54*a*-54*f* and the stop valves 55*a*-55*f* are closed before the construction work. Upon the construction work, when the second units 303*a*-303*d* and the branching unit 302 are connected by gas pipes 11*a*-11*d* and the liquid pipes 15*a*-15*d*, the stop valves 54*a*-54*f* are manually closed by the worker. Therefore, the stop valve is always open at the branching ports 50*a*-50*f* and branching ports 51*a*-51*f* to which the refrigerant piping (the gas pipe 11*a*-11*d* and the liquid pipes 15*a*-15*d*) is connected, while the stop valve is always closed at the branching ports 50*a*-50*f* and the branching ports 51*a*-51*f* to which no refrigerant pipe is connected.

<First Unit 301>

FIG. 2 is a refrigerant circuit diagram of the air-conditioning apparatus 100 of Embodiment 1 of the present invention.

The first unit 301 comprises a compressor 1, a four way valve 2, a first heat exchanger 3, a first fan 4, a check valve bridge comprising four check valves (a check valve 5, a check valve 25, a check valve 26, and a check valve 28), an accumulator 30, a high-pressure pipe 6, a low-pressure pipe 24, a pipe 27 and a pipe 29.

The compressor 1 suctions a refrigerant, compresses it into a high-temperature, high-pressure state, and has a variable operation capacity. The four way valve 2 is a flow path change-over mechanism to switch the direction of flow of the refrigerant, and has first to fourth ports. The first port is connected to the discharge side of the compressor 1, the second port is connected to the first heat exchanger 3, the third port is connected to the suction side of the compressor 1 and the fourth port is connected to the low-pressure pipe 24.

The four way valve 2 is configured to be switchable between a state in which the third port and the fourth port communicate with each other while at the same time the first port and the second port communicate with each other (the state in which the continuous line within the four way valve 2 communicates), and the state in which the second port and the third port communicate with each other while at the same time the first port and the fourth port communicate with each other (the state in which the broken lines within the four way valve 2 communicate).

The first heat exchanger 3 is, for example, a fin-and-tube heat exchanger of cross-fin type comprising a heat-transfer pipe and a plurality of fins, exchanges heat between the outdoor air and the refrigerant, and exhausts heat. The first fan 4 is configured to have a variable rotation speed, and supplies air to the first heat exchanger 3, and comprises a propeller fan or the like. The check valve bridge restricts the direction of flow of the refrigerant. The accumulator 30 has a function to accumulate refrigerant excessive for operation, and a function to prevent a lot of liquid refrigerant from entering the compressor 1 by retaining the liquid refrigerant that is temporarily generated when the operational state changes.

The first unit 301 includes a pressure sensor 201 in the discharge side of the compressor 1, and a pressure sensor 212 provided in the suction side of the compressor 1 to measure the refrigerant pressure at the installation location thereof. Further, a temperature sensor 202 is provided in the liquid side of the first heat exchanger 3, and measures the refrigerant temperature at the installation location. A temperature sensor 203 is provided in the air inlet, and measures the outdoor air temperature to serve as an outdoor air temperature detector.

<Branching Unit 302>

The branching unit 302 comprises branching ports 50*a*-50*f* for a plurality of branched pipes, branching ports 51*a*-51*f* for a plurality of branched pipes, a gas-liquid separator 7, opening/closing valves (opening/closing valves) 9*a*-9*f*, opening/closing valves (opening/closing valves) 10*a*-10*f*, check valves 16*a*-16*f*, check valves 17*a*-17*f*, stop valves 54*a*-54*f*, stop valves 55*a*-55*f*, a supercooling heat exchanger 19, a supercooling heat exchanger 21, a pressure-reducing mechanism 20, a pressure-reducing mechanism 22, a pipe 8, a pipe 18 and a pipe 23.

The gas-liquid separator 7 is for flowing a gas refrigerant to the pipe 8 and the liquid refrigerant to the pipe 18 by separating the refrigerant having entered the high-pressure pipe 6 into a part of a liquid refrigerant and a part of a gas refrigerant. The opening/closing valves 9*a*-9*f* and the opening/closing valves 10*a*-10*f* are for controlling the flow of the refrigerant by alternatively opening and closing these valves according to the operations of the second units 303*a*-303*d*. The check valves 16*a*-16*f* and the check valves 17*a*-17*f* are for restricting the direction of flow of the refrigerant.

The supercooling heat exchanger 19 and the supercooling heat exchanger 21 are for exchanging heat between the high-pressure refrigerant and the low-pressure refrigerant. The pressure-reducing mechanisms 20 and the pressure-reducing mechanism 22 are for controlling the fluid delivery rate of the refrigerant by variably setting the opening degree thereof.

In the branching unit 302, the pressure sensor 204 is provided between the pressure-reducing mechanisms 20 and the supercooling heat exchanger 19, the pressure sensor 205 is provided between the pressure-reducing mechanisms 20 and the supercooling heat exchanger 21, and they measure the refrigerant pressure at the installation locations. A temperature sensor 206 is provided at the high-pressure liquid side of the supercooling heat exchanger 21, the temperature sensor 210 is provided at the low-pressure inlet of the supercooling heat exchanger 21, and the temperature sensor 211 is provided at the low-pressure outlet of the supercooling heat exchanger 19, and measures the refrigerant temperature at the installation locations thereof.

<-Second Units 303*a*-303*d*>

The second units 303*a*-303*d* comprise use side pressure-reducing mechanisms 14*a*-14*d*, second heat exchangers 12*a*-12*d*, and second fans 13*a*-13*d*. The use side pressure-reducing mechanisms 14*a*-14*d* are for controlling the flow rate of the refrigerant by variably setting the opening degree thereof. The second heat exchangers 12*a*-12*d* are, for example, fin-and-tube heat exchangers of cross-fin type, each comprising a heat-transfer pipe and a plurality of fins, and exchange heat between the indoor air and the refrigerant. The second fans 13*a*-13*d* have variable rotation speeds, and supplies air to the second heat exchangers 12*a*-12*d*, and comprise a propeller fan or the like.

The second units 303*a*-303*d* are provided with temperature sensors 207*a*-207*d* in the liquid sides of the second heat exchangers 12*a*-12*d*, and temperature sensors 208*a*-208*d* in the gas sides of the second heat exchangers 12*a*-12*b*, which detect the refrigerant temperature at the installation locations thereof. Further, temperature sensors 209*a*-209*d* are provided in the air inlet, and measure the air temperatures at the installation locations thereof.

<Unit Control Unit 101, Controller Controlling Device 121>

FIG. 3 is a block diagram of the unit control unit 101 of the air-conditioning apparatus 100 of Embodiment 1 of the present invention. In the first unit 301, for example, a unit control unit 101 comprising a microcomputer is provided. In the external controller 320, for example, a controller controlling device 121 implemented by S/W is provided. In the unit control unit 101, a measuring unit 102, a computation unit 103, a control section 104, a unit communication unit 105, and a unit storage unit 106 are provided. In the unit control unit 101, each amount detected by each temperature sensor and each pressure sensor is input to the measuring unit 102, and an operation to determine various control actions such as calculating the saturation temperature at the detection pressure is performed by the computation unit 103 based on the input information, and each device such as the compressor 1 and the first fan 4 is controlled by the control section 104.

Further, the unit communication unit 105 is provided, into which communications data information is entered by means of communications including telephone line, LAN or wireless communication, and outputs the information to the outside. In the unit communication unit 105, cooling instruction (cooling ON/OFF), or heating instruction (heating ON/OFF) output by the use side remote control (not shown) are input to the unit control unit 101 by communication, or measured values of the measuring unit 102 or the device control value of the controller controlling device 121 is communicated. The unit storage unit 106 comprises a semiconductor memory or the like, and stores setting value used for normal operation.

In the controller controlling device 121 is provided an input unit 122, an external communication unit 123, an external storage unit 124, a special control unit 125, a determination unit 126 and a display screen 127.

On the input unit 122, the start of setting pipe setting error detection operation is input by a worker. Here, the setting pipe setting error detection operation refers to an operation to forcibly operate (forcibly switch) an opening/closing valve to determine whether the pipe connected to a second unit (connected pipe) and the setting pipe (set in the connection information) agree to one another, and detect, if any, point where the any of the connected pipes and the any of the setting pipes disagree. Forcibly operating refers to controlling to open or close the opening/closing valve irrespective of the operating state or the setting of the air-conditioning apparatus 100. The external communication unit 123 can receive input of communication data information and output the information to the outside by means of communications such as telephone line, LAN, or wireless communication. The external communication unit 123 transmits information input to the input unit 122 or control values of the opening/closing valves upon the setting pipe setting error detection operation to the unit communication unit 105, and receives operation data such as pressure or temperature from the unit communication unit 105.

The external storage unit 124 comprises a semiconductor memory or the like, and stores control setting values of each device upon the setting pipe setting error detection operation. The special control unit 125 performs computation of control values of each device upon the setting pipe setting error detection operation. The determination unit 126 determines whether the connected pipes and the setting pipes agree. The display screen 127 comprises a display unit such as a liquid crystal display unit installed in the external controller 320, and displays the result of the setting pipe setting error detection operation or the operational state of the air-conditioning apparatus 100.

The detection temperature of the temperature sensor, the detection pressure at the pressure sensor measured by the measuring unit 102 or the saturation temperature of the detection pressure of the pressure sensor computed by the computation unit 103 and the detection pressure of the pressure sensor are transmitted from the unit communication unit 105, and received by the external communication unit 123.

Further, in Embodiment 1, although the air-conditioning apparatus 100 includes "a controller controlling device 121 that includes an external storage unit 124 and a determination unit 126" corresponding to the "storage unit and the controller" of the present invention, the present invention may be configured as an air-conditioning system comprising, as a separate unit from the air-conditioning apparatus 100, such elements.

<Normal Operation Modes>

The air-conditioning apparatus 100 performs control of each device installed in the first unit 301 and the second units 303*a*-303*d* according to air-conditioning instructions requested by the second units 303*a*-303*d*. The air-conditioning apparatus 100, for example, can start cooling only operation mode by the cooling instruction on the second units 303*a*-303*d*, or heating only operation modes by the heating instruction.

In the cooling only operation mode, the apparatus is in a state as shown in FIG. 2, that is, the continuous lines within the four way valve 2 communicate, in other words, the apparatus is in a state in which the discharge side of the compressor 1 is connected to the gas side of the first heat exchanger 3, and the suction side of the compressor 1 is connected to the low-pressure pipe 24 via the check valve 25. Further, the pressure-reducing mechanism 20 is in the full-open opening degree. All of the second units 303*a*-303*d* are turned to be cooling ON, the opening/closing valves 9*a*-9*d* are open, and the opening/closing valves 10*a*-10*d* are closed.

The opening/closing valves 9*e*-9*f* and the opening/closing valves 10*e*-10*f* are closed since no second unit is connected to the branching port for the piping.

The high-temperature, high-pressure gas refrigerant discharged from the compressor 1 is sent to the first heat exchanger 3 via the four way valve 2, and transfers heat to the outdoor air blown by the first fan 4. Thereafter, the refrigerant passes through the high-pressure pipe 6 by way of the check valve 5, is sent to the gas-liquid separator 7 and enters the high-pressure side supercooling heat exchanger 19 by way of the pipe 18. The refrigerant having entered the supercooling heat exchanger 19 is cooled by the low-pressure refrigerant, and after passing through the pressure-reducing mechanisms 20, enters the high-pressure side of the supercooling heat exchanger 21, and is cooled by the low-pressure refrigerant. Thereafter, the refrigerant is distributed to the refrigerant flowing through the pressure-reducing mechanism 22, or check valves 17*a*-17*d*.

The refrigerant having entered the pressure-reducing mechanism 22 is subjected pressure reduction to become a low-pressure two-phase gas-liquid refrigerant, enters the low-pressure side of the supercooling heat exchanger 21, and is heated by the high-pressure refrigerant, and thereafter, enters the low-pressure side of the supercooling heat exchanger 19 to be heated again by the high-pressure refrigerant. Thereafter, the refrigerant passes through the pipe 23 and merges with the refrigerant having flowed through the check valves 17*a*-17*d* and the opening/closing valves 9*a*-9*d*.

The pressure-reducing mechanism 22 is controlled by the control section 104 shown in FIG. 3 so that degree of superheat at the low-pressure side outlet of the supercooling heat exchanger 19 becomes a predetermined value.

The degree of superheat at the low-pressure side outlet of the supercooling heat exchanger 19, is obtained by subtracting the detection temperature of the temperature sensor 210 from the detection temperature of the temperature sensor 211. On the other hand, the refrigerant having entered the check valves 17*a*-17*d*, passes through the branching ports 51*a*-51*d* and the liquid pipes 15*a*-15*d* and subjected to pressure reduction at the use side pressure-reducing mechanisms 14*a*-14*d* to become low-pressure, two phase refrigerant, cools the indoor air in the second heat exchangers 12*a*-12*d* delivered by the second fans 13*a*-13*d* to become the low-pressure gas refrigerant. Thereafter, the refrigerant passes through the gas pipes 11*a*-11*d*, the branching port 50*a*-50*d*, and the opening/closing valves 9*a*-9*d*, and merges with the refrigerant having flowed to the pressure-reducing mechanism 22.

In the use side pressure-reducing mechanisms 14*a*-14*d*, the degrees of superheat at the second heat exchangers 12*a*-12*d* are controlled by the control section 104 shown in FIG. 3 to be a predetermined degree. The degree of superheat at second heat exchangers 12*a*-12*b* is obtained by subtracting the detection temperature of the temperature sensors 207*a*-207*d* from the detection temperatures of the temperature sensors 208*a*-208*d*.

Thereafter, the refrigerant having merged passes through the accumulator 30 by way of the low-pressure pipe 24, the check valve 25 and the four way valve 2, and is suctioned by the compressor 1 again. The operation frequency of the compressor 1 is controlled by the control section 104 shown in FIG. 3 so that the evaporating temperature becomes a predetermined value (for example, 0 degrees C.). The evaporating temperature is a saturation temperature at the detection pressure of the pressure sensor 212. The rotation speed of the first fan 40 is controlled by the control section 104 so that the condensing temperature becomes a predetermined value (for example, 40 degrees C.). The condensing temperature is a saturation temperature at the detection pressure of the pressure sensor 201.

Next, the heating only operation mode will be described. In the heating only operation mode, the state shown in FIG. 2 is achieved in which the broken lines within the four way valve 2 communicate with each other, in other words, the state is achieved in which the discharge side of the compressor 1 is connected to the high-pressure pipe 6 by way of the check valve 26, and the suction side of the compressor 1 is connected to the gas side of the first heat exchanger 3. The pressure-reducing mechanisms 20 is set at a full-close opening degree. All of the second units 303*a*-303*d* is set to heating ON, and the opening/closing valves 9*a*-9*d* are closed, and the opening/closing valves 10*a*-10*d* are open.

The opening/closing valves 9*e*-9*f* and the solenoid valve 10*e*-10*f* are closed since no second unit is connected to the branching port (for the piping).

The high-temperature, high-pressure gas refrigerant discharged from the compressor 1, after passing the high-pressure pipe 6 by way of the four way valve 2 and the check valve 26, enters the gas-liquid separator 7. The refrigerant thereafter passes through the pipe 8 and the opening/closing valves 10*a*-10*d*, flows in the gas pipes 11*a*-11*d*, and thereafter, enters the second heat exchangers 12*a*-12*d*. The refrigerant in the second heat exchangers 12*a*-12*d* heats the indoor air delivered by the second fans 13*a*-13*d* and becomes a high pressure liquid refrigerant. The refrigerant is thereafter subjected to pressure reduction at the use side pressure-reducing mechanisms 14*a*-14*d*, passes through the liquid pipes 15*a*-15*d*, check valves 16*a*-16*d* and flows in the high-pressure side of the supercooling heat exchanger 21, and thereafter is subjected to pressure reduction at the pressure-reducing mechanism 22 to become a medium-pressure two-phase gas-liquid refrigerant.

The use side pressure-reducing mechanisms 14*a*-14*d* are controlled so that the degrees of supercooling at the second heat exchangers 12*a*-12*d* become predetermined values. The degrees of supercooling at the second heat exchangers 12*a*-12*d* are computed by subtracting the temperature detected by the temperature sensors 207*a*-207*d* (corresponding to supercooling degree detector in the claims) from the saturation temperature at the pressure detected by the pressure sensor 204 (corresponding to the supercooling degree detector in the claims). The pressure-reducing mechanism 22 is controlled by the control section 104 to such an opening degree that the medium pressure difference becomes a predetermined value. The medium pressure difference is obtained by subtracting the pressure detected by the pressure sensor 205 from the pressure detected by the pressure sensor 204.

The refrigerant thereafter enters the low-pressure side of the supercooling heat exchanger 21, is heated by the high-pressure refrigerant, and enters the low-pressure pipe 24 via the supercooling heat exchanger 19 and the pipe 23. The refrigerant having entered the first heat exchanger 3 by way of the check valve 28 receives heat from the outdoor air delivered by the first fan 4 and becomes low-pressure gas refrigerant. The refrigerant thereafter passes through the four way valve 2 and passes the accumulator 30 and then is suctioned by the compressor 1 again. The operation frequency of the compressor 1 is controlled by the control section 104 shown in FIG. 3 so that the condensing temperature becomes a predetermined value (for example, 50 degrees C.). The rotation speed of the first fan 4 is controlled by the control section 104 so that the evaporating temperature becomes a predetermined value (for example, 0 degrees C.).

The opening/closing valve 9*a* and the opening/closing valve 10*a* are referred correctively as the opening/closing valve (a) of the connected pipe "a". Similarly, the opening/closing valves 9*b*-9*f* and the opening/closing valves 10*b*-10*f* are referred to correctly as the opening/closing valves b-f of the connected pipes "b"-"f".

<Branching Port Setting Error Detection Operation>

In Embodiment 1, it is assumed that the technique of the present application is used in the manner described below. Upon the installation construction of the air-conditioning apparatus at the installation location, the worker connects the first unit 301, the branching unit 302, the second units 303*a*-303*d* by the high-pressure pipe 6, the low-pressure pipe 24, the gas pipes 11*a*-11*d* and the liquid pipes 15*a*-15*d*. Then, stop valves 54*a*-54*d* of the branching ports 50*a*-50*d* and stop valves 55*a*-55*d* of the branching ports 51*a*-51*d* to which the refrigerant piping (the gas pipes 11*a*-11*d* and the liquid pipes 15*a*-15*d*) is connected, are opened (a stop valve of any of the branching ports to which no refrigerant piping is connected remains closed). Thereafter, it is set as each of the setting pipes <a>-<f> which one of the connected pipes "a"-"f" of the branching unit 302 each of the second units 303*a*-303*d* is connected.

Here, the connection to the pipes "a"-"f" of the second units 303*a*-303*d* (connecting to the gas pipes 11*a*-11*d* and liquid pipes 15*a*-15*d*) and setting of the setting pipes <a>-<f> are performed individually, there may be cases where there is disagreement in correspondence relations between the connected pipes and the setting pipes due to setting error of the setting pipe caused by errors in the work. In the refrigerant circuit diagram of FIG. 2, it is determined which of the opening/closing valves 9*a*-9*f* and the opening/closing valves 10*a*-10*f* the target of operation will be is determined based on the setting pipes <a>-<f>, and therefore it becomes difficult to perform normal interior temperature conditioning where there is disagreement in correspondence relations.

In the present application, the setting error of the setting pipe is distinguished into a closed path setting error and an open path setting error.

The closed path setting error refers to erroneously setting, as a setting pipe, a closed path pipe that is a pipe to which no second unit 303*a*-303*d* is connected (or including such a pipe in the connection information), and a setting error in which, for example in the refrigerant circuit diagram of FIG. 2, although the second unit 303*a* is connected to the connected pipe "a", the setting pipe is <f> (although no connected pipe "f" is connected to any of the second units). In this case, when the second unit 303*a* is activated to cooling ON or heating ON from the stopped state, the opening/closing valve 9*f* or the opening/closing valve 10*f* is open, and the opening/closing valve 9*a* and the opening/closing valve 10*a* remain closed. Therefore, the refrigerant does not flow to the second unit 303*a*.

Since no refrigerant pipe is connected to the branching port 50*f* and the branching port 51*f*, and the stop valve is always closed, the refrigerant does not flow even when the opening/closing valve 10*f* is opened. Where the construction is completed in unawareness of a setting error of a setting pipe, and usage is started, indoor temperature conditioning by the second unit 303*a* cannot be performed appropriately, which is the cause of the subsequent user complaint.

On the other hand, the open path setting error refers to erroneously setting, as a setting pipe, an open pipe (branching port) to which other one of the second units 303 is connected. This setting is a setting error in which, in the refrigerant circuit diagram of FIG. 2, for example, although the second unit 303*a* is connected to the connected pipe "a", the setting pipe is set to <c> (the connected pipe "c" is actually connected to another second unit). Also in this case, if the second unit 303*a* set to the setting pipe <c> is stopped when the second unit 303*c* is activated to cooling ON or heating ON from the stopped state, the refrigerant does not flow to the second unit 303*c* since the opening/closing valve 9*c* and the opening/closing valve 10*c* remain closed. Therefore, when the construction is completed in unawareness of the open path setting error, and the use is started, indoor temperature conditioning of the second unit 303*c* cannot be performed appropriately, which is the cause of the subsequent user complaint.

Then, upon completion of the installation construction, a setting pipe setting error detection operation to detect points where there is disagreement in correspondence relations between the connected pipes and the setting pipes is performed as a test run to avoid the above-mentioned a state. There have conventionally been attempts to detect disagreement of correspondence relations between the connected pipes and the setting pipes. For example, a method is disclosed in Patent Literature 1 in which the second units 303*a*-303*d* are changed over to a cooling or a heating operation to determine whether the correspondence relations between the connected pipes and the setting pipes agree on the basis of a change in a temperature relation between the suction temperature and the detection temperature.

FIG. 4 shows example 1 of the setting error of a setting pipe of the air-conditioning apparatus 100 of Embodiment 1 of the present invention.

With example 1 of the setting error of a setting pipe as shown in FIG. 4, where the correspondence relation is searched with all the second units 303*a*-303*d* being set to cooling ON, there are the closed path setting errors in the second unit 303*a* and the second unit 303*b*. Further, since there is no second unit 303 set to the setting pipe <a> or the setting pipe <b>, the refrigerant does not flow to the second unit 303*a* and the second unit 303*b*. Furthermore, when the second unit 303*c* is turned to heating ON in this state, the refrigerant flow in the second unit 303*d* is that of heating, and the second heat exchanger 12*d* serves as a condenser in which it rejects heat from the refrigerant.

As a result, only the second heat exchanger 12*c* serves as an evaporator that absorbs heat from the refrigerant, and when the heat exchange capacity of the second heat exchanger 12*c* is small, the low-pressure side pressure of the refrigerant becomes extremely low, in which case there is a possibility that the detection operation is stopped in the midway thereof. As described above, in order to automatically detect points of setting error without the stop in the midway of the operation, it is necessary to distinguish the closed path setting error and the open path setting error from each other to detect the disagreement of correspondence relations between the connected pipes and the setting pipes.

After completion of the installation construction, the worker inputs start of the setting pipe setting error detection operation from the input unit 122 of the external controller 320. The setting error detection operation includes the following two. One is the cooling operation setting error detection operation, the other is a heating setting pipe setting error detection operation. Then, it is determined which one of the operations runs depending on the outdoor air temperature upon the start of the setting error detection operation.

For example, where the outdoor air temperature is 10 degrees C. (preset value) or higher, the cooling operation setting error detection operation runs, while the heating setting pipe setting error detection operation runs if the outdoor air temperature is lower than 10 degrees C. (preset value). Where the cooling operation setting error detection operation is performed when the outdoor air temperature is low, the high-pressure side pressure becomes extremely low, and the low-pressure side pressure also extremely reduces. Therefore, there is a possibility that the operation stops in the midway thereof.

Conversely, where the heating setting pipe setting error detection operation is performed when the outdoor air temperature is high, the low-pressure side pressure becomes extremely high, and the high-pressure side pressure also becomes extremely high, so that there is a possibility that the operation stops in the midway thereof. By selectively using the cooling operation setting error detection operation and the heating setting pipe setting error detection operation depending on the outdoor air temperature, it is possible to perform the setting pipe setting error detection operation in a wide range of the environmental temperature. Hereafter, each of the detection operations will be described.

<Cooling Setting Pipe Setting Error Detection Operation>

FIG. 5 is a first flowchart showing the cooling operation setting error detection operation of the air-conditioning apparatus 100 of Embodiment 1 of the present invention. FIG. 6 is a table showing the flow of the correction of the setting error of the setting pipes in example 1 of the setting error of the setting pipe on the air-conditioning apparatus 100 of example of Embodiment 1 of the present invention.

First, the cooling operation setting error detection operation will be described with reference to FIG. 5 and FIG. 6.

In the following descriptions, it is assumed that the number of connected pipes and the number of the setting pipes correspond to one another.

When the cooling operation setting error detection operation is started, all the second units 303*a*-303*d* are set to cooling ON in step S1, and the cooling only operation mode is started. After continuation of the operation for a predetermined time period (for example, 10 minutes), presence or absence of the closed path setting error is determined in step S2.

The presence or absence of the closed path setting error of the closed path is determined by the determination unit 126 based on the relation between the detection temperature TICI of the temperature sensors 207*a*-207*d*, and the detection temperature Tai of the temperature sensors 209*a*-209*d*. Where the opening/closing valves 9*a*-9*d* are opened, and cool, low-pressure, two phase refrigerant flows to the second units 303*a*-303*d*, detection temperature TICI of the temperature sensor 207*a* that is the piping temperature of the liquid sides of the second heat exchangers 12*a*-12*d* becomes lower than the detection temperature Tai of the temperature sensors 209*a*-209*d* that are the indoor air temperatures (TICI<Tai).

Therefore, where TICI<Tai in all the second units 303*a*-303*d*, it is determined that a low temperature refrigerant is flowing in all the second units 303*a*-303*d*, and it is determined by the determination unit 126 the closed path setting error is absent. If any second unit where TICI greater than or equal to Tai, it is determined there is a second unit 303 in which low temperature refrigerant does not flow, it is determined by the determination unit 126 that there is a closed path setting error.

There may be cases where detection temperature TICI<Tai depending on the installation location or errors in measurement, even when low temperature refrigerant is not flowing therein. Therefore, detection temperature Tai that is the indoor air temperature may be corrected to Tai' (for example, by 2 degrees C. as Tai'=Tai-2 degrees C.) and the low temperature refrigerant is flowing when TICI<Tar, and it may be determined that low temperature refrigerant is not flowing where TICI greater than or equal to Tai'. With this configuration, it is possible to accurately detect presence or absence of the flow of the low temperature refrigerant.

With the case of example 1 of setting error of a setting pipe as shown in FIG. 4, although TICI<Tai in step S2 in second unit 303*c* and second unit 303*d*, TICI greater than or equal to Tai establishes in the second unit 303*a* and second unit 303*b*. Therefore, it is determined that there is a closed path setting error, and the first search is performed in which closed path pipe that is erroneously set in step S3 is searched. The reason for determining in step S2 that there is a closed path setting error in the second unit 303*a* and second unit 303*b* is that the opening/closing valve 9*a* and the opening/closing valve 9*b* of the connected pipe to which the second unit 303*a* and the second unit 303*b* are connected do not open since the setting pipe <a> or the setting pipe <b> is not set, in either of the second units 303*a*-303*d*.

Based on this, the opening/closing valve of a pipe that is not set to any of the second units 303*a*-303*d* are forcibly operated. With the case of FIG. 4, since the pipes "a" and "b" are not set, these two opening/closing valves are forcibly operated sequentially one by one by the special control unit 125. That is, the opening/closing valve (a) of the connected pipe "a" is set as the cooling flow path, and it is determined by the determination unit 126 whether there is a flow of low temperature refrigerant (TICI<Tai) in the second unit 303*a* and the second unit 303*b*.

Since the flow of low temperature refrigerant is present in the second unit 303*a*, it is understood that the second unit 303*a* is connected to the connected pipe "a". Next, the opening/closing valve (b) of the piping connected pipe "b" is forcibly turned to the cooling flow path, and it is determined in the second unit 303*b* whether there is a flow of low temperature refrigerant. Then the flow of low temperature refrigerant is determined to be present in the second unit 303*b*, and therefore it is understood that the second unit 303*b* is connected to the connected pipe "b". After the completion of determination, the forcibly operated state of the opening/closing valve is removed (the opening/closing state of the opening/closing valve before the forcible operation is restored, and the process proceeds to step S4.

For the opening/closing valve (a) of the pipe "a" for which determination is terminated before the forcible operation of the opening/closing valve b, the forcibly operated state may be removed (the refrigerant path is set back to the stop flow path from the cooling flow path), or may not be removed (the refrigerant path remains in the cooling flow path). In the manner as described above, first search is performed.

In FIG. 4 of Embodiment 1, although the number of closed path pipe is same as that of second unit in which closed path setting error is present, the present technique is not limited to this case.

For example, the number of the branching ports for the branched pipes of the branching unit 302 may be 8, the number of the closed path pipe may be 4, and the number of the second units with a closed path setting error may be 2. In this case, since the number of the closed path pipe is greater than the number of the second units with closed path setting error, there may be cases where a low temperature refrigerant flow is determined to be absent in a second unit with a closed path setting error even when the opening/closing valve is forcibly operated. Further, forcible operation from the special control unit 125 is communicated from the external communication unit 123 to the unit communication unit 105. Further, the result of determination by the determination unit 126 is stored in the external storage unit 124.

Thereafter, correction of connection information is performed in step S4. First, the point where closed path setting error is present, that is, the point where the connected pipes and the setting pipes disagree in second unit (second unit with the setting error and the correct connected pipe of the second unit) is displayed on the display screen 127 (display points with closed path setting errors). The worker then confirms the display content and corrects by the input unit 122 the point where the setting error of the setting pipe is present from the state in the start of the detection operation to the state after the correction of connection information as shown in FIG. 6 (correction of points of closed path setting errors).

That is, the setting pipe of the second unit 303*a* is reset to <a>, the setting pipe of the second unit 303*b* is reset to <b>. Thereafter, completion of points of setting error is input to the input unit 122. After continuation of operation for a predetermined time, presence or absence of the closed path setting error is determined again in step S2. By the correction, it is determined that low temperature refrigerant is flowing in all the second units 303*a*-303*d*, and there is no closed path setting error. Here, in step S2, the reason why it is determined there is no closed path setting error for any of the second units 303*a*-303*d* is because each of all the connected pipe to which a second unit 303*a*-303*d* is connected is set for any of the setting pipe of the second units 303*a*-303*d*.

In this way, in the air-conditioning apparatus 100, since presence or absence of the closed path setting error is determined, a second unit 303*a* with a closed path setting error can be detected in an early stage, and the worker can appropriately respond to presence or absence of the closed path setting error.

In the correction of connection information in Embodiment 1 (S4), the worker performs the correction. However, the special control unit 125 may automatically correct the point where the setting error of a setting pipe is present, on the basis of the result of the first search (S3). This can reduce the load of the construction work for the worker, as well as making it possible to suppress mistakes in re-setting, and it becomes possible to finish the construction work in an early stage and achieve an accurate construction work.

Next, the process proceeds to step S5 and second search in which erroneously set open branching port is searched is performed.

In the second search, all the connected pipes that are set as the setting branching port of the second units 303*a*-303*d* are the target of the forcible operation.

Here, the setting pipes of the second unit 303*a* and the second unit 303*b* are supposed to be appropriately corrected in step S4, and these could have been omitted from the target of forcible operation. However, since there may be cases where the worker may commit a setting error in the correction work in step S4, all the connected pipes that are set as the setting branching of the port second units 303*a*-303*d* are the targets of the forcible operation in the second search. Then, since according to "after correction of connection information" in FIG. 6, connected pipes "a", "b", "c", and "d" are set, the four opening/closing valves are forcibly operated sequentially one by one from the special control unit 125.

However, as will be described later, in the case where the number of the connected pipes and the setting pipes disagree, all the pipes of the plurality of branched pipes are the target of forcible operation.

In the second search, opening/closing valve of a connected pipe that is the operation target is forcibly operated from the state of the cooling flow path (opening/closing valve 9 is open, the opening/closing valve 10 is closed) to the heating flow path (the opening/closing valve 9 is closed, and the opening/closing valve 10 is open).

For example, when the opening/closing valve (a) is set to the state of the cooling flow path to the heating flow path, the refrigerant flow changes in the following manner from that of the cooling only operation mode. The high-temperature, high-pressure gas refrigerant discharged from the compressor 1 passes through the four way valve 2 to flow in the gas-liquid separator 7, is split into the refrigerant flowing in the pipe 18 and the refrigerant flowing in the pipe 8. The refrigerant having flowed in the pipe 18 is cooled by the low-pressure refrigerant in the high-pressure side of the supercooling heat exchanger 19, and after passage of the pressure-reducing mechanisms 20, merges with the refrigerant having flowed in the pipe 8.

On the other hand, the refrigerant having flowed in the pipe 8 passes through the opening/closing valve 9*a*, and the gas pipe 11*a*, and transfers heat to the indoor air delivered by the second fans 13*a* at the second heat exchanger 12*a*, and becomes a high pressure liquid refrigerant. Thereafter, the refrigerant is subjected to pressure reduction at the use side pressure-reducing mechanisms 14*a*, and after passage of the check valve 16*a*, merges with the refrigerant having flowed in the pipe 18. After the merge, the refrigerant enters the high-pressure side of the supercooling heat exchanger 21, and is cooled by the low-pressure refrigerant. Thereafter, the refrigerant is distributed to the refrigerant flowing in the pressure-reducing mechanism 22 or the check valves 17*b*-17*d*. The refrigerant having entered the check valves 17*b*-17*d* passes through the branching ports 51*b*-51*d* and the liquid pipes 15*b*-15*d*, and is subjected to pressure reduction at the use side pressure-reducing mechanisms 14*b*-14*d* to become a low-pressure, two phase refrigerant, cools the indoor air at the second heat exchangers 12*b*-12*d* to be low-pressure gas refrigerant. Thereafter, the refrigerant, by way of the gas pipe 11*b*-11*d*, the branching ports 50*b*-50*d* and the opening/closing valves 9*b*-9*d*, merges with the refrigerant having flowed to the pressure-reducing mechanism 22. Other refrigerant flows are same as those of the cooling only operation mode.

By setting the opening/closing valve (a) for the heating flow path, the warm gas refrigerant flows in the second unit 303*a* in which before the forcible operation the cool two-phase gas-liquid refrigerant was flowing after the forcible operation. That is, when in the cooling flow path, detection temperature TICI of the temperature sensor 207*a* that is the piping temperature at the liquid side of the second heat exchanger second heat exchanger 12*a* is lower than the detection temperature Tai of the temperature sensor 209*a* that is the indoor air temperature (TICI<Tai), it becomes that TICI greater than or equal to Tai establishes after the flow path has turned to the heating flow path, cools two-phase gas-liquid refrigerant (low temperature refrigerant) is not flowing therein.

In this way, a second unit in which TICI greater than or equal to Tai establishes when the opening/closing valve is forcibly operated is determined by the determination unit 126.

When the correspondence relation between the setting pipe of the second unit in which TICI greater than or equal to Tai establishes, and the connected pipe in which the opening/closing valve is forcibly operated agree, it is determined by the determination unit 126 that setting pipe appropriateness is achieved (setting pipe is appropriately set) in the use side unit, and if they do not agree, it is determined by the determination unit 126 that there is an open path setting error. Here, since TICI greater than or equal to Tai establishes in the second unit 303*a* whose setting pipe is <a> when the opening/closing valve (a) of the connected pipe "a" is operated, the setting pipe of the second unit 303*a* is determined to be appropriate.

Furthermore, because when the opening/closing valve b for the pipe "b" is operated, TICI greater than or equal to Tai establishes for the second unit 303*b* for which setting pipe is "b", the setting pipe of the second unit 303*a* is determined to be appropriate.

On the other hand, after the forcibly operated state is removed (the refrigerant path is set back to the cooling flow path), when the opening/closing valve (c) of the pipe "c" is forcibly operated to be the heating flow path, TICI greater than or equal to Tai establishes in the second unit 303*c* for which the setting pipe is <d>, not the second unit 303*d* for which the setting pipe is <c>. Therefore, the second unit 303*c* is determined to have an open path setting error, while it is possible to confirm that the second unit 303*c* connected to the connected pipe is "c".

With the above configuration, for the second unit 303*a* and second unit 303*b*, setting pipe appropriateness is achieved, while for the second unit 303*c* and second unit 303*d*, open path setting error results.

Since there may be cases where detection temperature TICI<Tai established due to the installation location or errors in measurement, even when no low temperature refrigerant is flowing therein, the detection temperature Tai that is the indoor air temperature may be corrected to obtain Tai' (for example correction by 2 degrees C. to achieve Tai'=Tai-2 degrees C.), and it is determined that low temperature refrigerant is flowing therein where TICI<Tar, while it may be determined that low temperature refrigerant is not flowing when TICI greater than or equal to Tai' establishes. With this configuration, it is possible to accurately detect presence or absence of flow of low temperature refrigerant.

When all the opening/closing valves of a connected pipe that are the operation targets are operated, then in step S6 the presence or absence of the open path setting error is determined. Since there are open path setting errors in the second unit 303*c* and the second unit 303*d*, the process proceeds to step S7. In step S7, second search correction is performed. First, the point where a setting error of the setting pipe is present, that is, the point where the connected pipes and the setting pipes disagree in the use side unit (the second unit is erroneously set as an open path pipe and a pipe to which the second unit is actually connected), are displayed on the display screen 127 (display points with closed path setting errors). By confirming the display content, the worker uses the input unit 122 to correct the point where setting error of the setting pipe is present as shown in FIG. 6 from the state after correction of connection information to the state after the second search correction (correction of points of closed path setting errors).

In the second search correction (S7) in Embodiment 1, the worker performs correction. However, the special control unit 125 may automatically correct the point where the setting error of a setting pipe is present, based on the result of the second search (S5). This can reduce the load of the construction work for the worker, as well as making it possible to suppress mistakes in re-setting, and it becomes possible to finish the construction work in an early stage and achieve an accurate construction work.

After the second search correction, the connected pipes and the setting pipes agree in correspondence, and the state becomes that where there is no setting error. Thereafter, operation is continued for a predetermined time period, and it is determined that there is no closed path setting error again in step S2. Thereafter, second search is performed in step S5, and it is determined that there is no open path setting error in step S6, and the cooling operation setting error detection operation is completed.

By performing the setting pipe setting error detection operation in the manner as describe above, in example 1 of the setting error of a setting pipe in which a closed path setting error, in which a closed path pipe to which no second unit is connected, is included in the connection information (the closed path pipe is erroneously set to a setting pipe) even when there is any closed path setting error, it is possible to appropriately determine the correspondence relations between the connected pipes and the setting pipes without hang.

That is, since it is possible to detect points where the connected pipes and the setting pipes disagree, it becomes easy to correct a setting pipe to be set for an appropriate connected pipe, as well as automatically determine whether a correspondence relations between the connected pipes and the setting pipes is appropriate. Then, by performing the setting pipe setting error detection operation after completion of the construction and appropriately setting the setting of connection information, it is possible to avoid start of usage in the state in which any setting error of a setting pipe is present, the factors to cause user complaints may be eradicated to improve the service organization.

In the second search, although the opening/closing valve is changed to the heating flow path from the cooling flow path, the configuration is not limited to this, and it may be changed from the cooling flow path to the stop flow path (the opening/closing valve 9 is closed, and the opening/closing valve 10 is closed). With this configuration, it is possible to detect correspondence relations between the connected pipes and the setting pipes of not only the air-conditioning apparatus 100 in which the cooling and heating concurrent operation can be performed as in Embodiment 1 of the present invention, but also an air-conditioning apparatus 100 in which cooling and heating are switchable. Also in this case, since cool two-phase gas-liquid refrigerant flows into second unit in the cooling flow path, it is determined that the flow path is the cooling flow path with the cool refrigerant flowing where TICI<Tai, and it is determined that the flow path is the stop flow path with the cool refrigerant not flowing, where TICI is greater than or equal to Tai.

However, it is only that the refrigerant does not flow in the stop flow path, hot refrigerant does not flow unlike in the heating flow path, it takes a time until the temperature changes to TICI greater than or equal to Tai. Therefore, in Embodiment 1 of the present invention in which the cooling and heating concurrent operation can be performed, the opening/closing valve is switched from the cooling flow path to the heating flow path.

FIG. 7 is a second flowchart of a cooling setting error detection operation of the air-conditioning apparatus 100 of embodiment 1 of the present invention. FIG. 8 is a table showing the flow of correction of connection information of example 2 of a setting error of the setting pipe of an air-conditioning apparatus 100 in embodiment 1 of the present invention.

In example 1 of a setting error of the setting pipe, description has been given of a case where the number of connected pipes and the number of setting pipes agree. In example 2 of a setting error of the setting pipe, a case will be described in which the number of connected pipes and the number of setting pipes disagree (the number of connected pipes>the number of setting pipes) with reference to FIG. 7 and FIG. 8. Although not shown in the drawings, example 2 of a setting error of the setting pipe assumes a case where the second unit 303*e* is connected to pipe "e" in FIG. 4.

Where there may possibly be cases in which the number of connected pipes and the number of setting pipes disagree, first, as shown in FIG. 7, it is confirmed in step S0 whether the number of connected pipes and the number of setting pipes agree. As a method for confirmation, the following may be applicable: flowing refrigerant through all of the branched plurality of pipes, determining a refrigerant flow from the temperature sensor or the like by the determination unit 126, and counting the number of pipes to which the refrigerant has actually flowed. In example 2 of a setting error of the setting pipe, five second units are connected via pipes. Therefore, the number of connected pipes is 5. On the other hand, it is understood that since the number of setting pipes is 4, the number of connected pipes and the number of setting pipes disagree.

Where the number of connected pipes and the number of setting pipes disagree, in S1-S4, processes same as example 1 of a setting error of the setting pipe are performed (and the descriptions therefor are omitted), but in the second search in S5, all the pipes are the target of forcible operation.

Here, when the opening/closing valve a for pipe "a" is operated, TICI greater than or equal to Tai establishes for a second unit 303*a* for which setting pipe is <a>. Therefore, the setting pipe for the second unit 303*a* is determined to be appropriate. Further, when the opening/closing valve b for pipe "b" is operated, TICI greater than or equal to Tai establishes for a second unit 303*b* for which setting pipe is <b>. Therefore, the setting pipe for the second unit 303*a* is determined to be appropriate.

On the other hand, when the opening/closing valve c for pipe "c" is forcibly operated to the heating flow path, TICI greater than or equal to Tai establishes for a second unit 303*c* for which setting pipe is <d>, not for second unit 303*d* for which the setting pipe is <c>. Further, when the opening/closing valve d for pipe "d" is forcibly operated to the heating flow path, TICI greater than or equal to Tai establishes for a second unit 303*d* for which setting pipe is <c>, not for the second unit 303*c* for which setting pipe is <c>. Moreover, when the opening/closing valve e for pipe "e" is forcibly operated to the heating flow path, TICI greater than or equal to Tai establishes for the second unit 303*e*, which is not set to the setting pipe.

Therefore, it is possible to perform correction as in the state after the second search correction as shown in shown in FIG. 8.

FIG. 9 is a table showing the flow of correction of the connection information of example 3 of a setting error of the setting pipe in the air-conditioning apparatus 100 of embodiment 1 of the present invention.

In example 3 of a setting error of the setting pipe, a case will be described in which the number of connected pipes and the number of setting pipes disagree (the number of connected pipes<the number of setting pipes) with reference to FIG. 7 and FIG. 9.

Where there may possibly be the case in which the number of connected pipes and the number of setting pipes disagree, first, as shown in FIG. 7, it is confirmed in step S0 whether the number of connected pipes and the number of setting pipes agree. As a method for confirmation, the following may be applicable: flowing a refrigerant to all of the branched plurality of pipes, determining a refrigerant flow from the temperature sensor or the like by the determination unit 126, and counting the number of pipes to which the refrigerant has actually flowed. In example 3 of a setting error of the setting pipe, since 4 second units are connected via pipes, the number of connected pipes is 4. On the other hand, since the number of setting pipes is 5, it is understood that the number of connected pipes and the number of setting pipes disagree.

When the number of connected pipes and the number of setting pipes disagree, a process is executed in steps S1-S4 that are same as example 1 of a setting error of the setting pipe. (explanations therefor are omitted), all the pipes are target of forcible operation in the second search S5.

Here, when the opening/closing valve a for pipe "a" is operated, TICI greater than or equal to Tai establishes for a second unit 303*a* for which setting pipe is <a>. Therefore, setting pipe for the second unit 303*a* is determined to be appropriate.

On the other hand, when the opening/closing valve b for pipe "b" is forcibly operated to the heating flow path, although there should be no connected second unit, TICI greater than or equal to Tai establishes for a second unit 303*b* for which setting pipe is <e>. Further, when the opening/closing valve c for pipe "c" is forcibly operated to the heating flow path, TICI greater than or equal to Tai establishes for a second unit 303*c* for which setting pipe is <d>, not for the second unit 303*d* for which setting pipe is <c>. Further, when the opening/closing valve d for pipe "d" is forcibly operated to the heating flow path, TICI greater than or equal to Tai establishes for a second unit 303*d* for which setting pipe is <c>, not for the second unit 303*c* for which setting pipe is <c>. Furthermore, when the opening/closing valve e for pipe "e" is forcibly operated to the heating flow path, TICI greater than or equal to Tai does not establish in any of the second units including second unit 303*b* for which setting pipe is <e>.

Therefore, it is possible to perform correction in the manner as shown in the state after the second search correction in FIG. 9.

As described above, it is possible not only for the case where the number of connected pipes and the number of setting pipes agree, but also for the case where the number of connected pipes and the number of setting pipes disagree, to perform correction to correct connection information by performing the setting error detection operation.

FIG. 10 shows example 4 of a setting error of the setting pipe in the air-conditioning apparatus 100 of embodiment 1 of the present invention. FIG. 11 is a setting error table showing the flow of correction of example 4 of a setting error of the setting pipe in the air-conditioning apparatus 100 of embodiment 1 of the present invention.

Here, a flow of a detection operation is described of example 2 of a setting error of the setting pipe as shown in FIG. 10. Example 2 of a setting error of the setting pipe as shown in FIG. 10, unlike example 1 of a setting error of the setting pipe as shown in FIG. 4, setting pipes for the second unit 303*c* and the second unit 303*d* are erroneously set to "e" and "f", which are closed path pipes. Further, setting pipes for the second unit 303*a* and the second unit 303*b* are erroneously set to closed path pipes "c" and "d".

Therefore, even though the second unit 303*c* and the second unit 303*d* are erroneously set to the closed path pipes, since the setting pipe in the second unit 303*a* and the second unit 303*b* are erroneously set to pipe "c" and "d", the setting state as the start of the detection operation is such that the refrigerant flows.

When the cooling operation setting error detection operation starts according to the flowchart shown in FIG. 5, the cooling only operation mode starts in step S1, and since in step S2 there is no second unit for which the setting pipe is <a> or <b>, the refrigerant does not flow in the second unit 303*a* and the second unit 303*b* and TICI greater than or equal to Tai establishes, and it is determined that a closed path setting error is present. Thereafter, in step S3, the first search is performed. More specifically, an opening/closing valve of a connected pipe that is not set to any of the second units 303*a*-303*d* is forcibly operated. As shown in FIG. 10, in example 2 of the setting error of a setting pipe, the connected pipes "a" and "b" are not set. Therefore, the two opening/closing valves are forcibly operated sequentially one by one from the special control unit 125.

That is, first, the opening/closing valve (a) of the connected pipe "a" is set to a cooling flow path, and it is determined by the determination unit 126 whether a low temperature refrigerant flow is present (TICI<Tai) in the second unit 303*a* and the second unit 303*b*. Then, since a flow of low temperature refrigerant is present in the second unit 303*a*, it is understood that the second unit 303*a* is connected to the connected pipe "a". Next, opening/closing valve (b) of the piping connected pipe "b" is forcibly switched to the cooling flow path, and it is determined in the second unit 303*b* whether there is a flow of low temperature refrigerant. Then, since the flow of low temperature refrigerant is determined to be present in the second unit 303*b*, it is understood that the second unit 303*b* is connected to the connected pipe "b". After the completion of determination, the forcibly operated state is removed and the process proceeds to step S4.

The first search correction is performed in step S4, and the point where the setting error of the setting pipe is present is corrected in the manner as shown in FIG. 11 from the state of the start of the detection operation to the state after the correction of connection information (first time). Thereafter, after elapse of a predetermined time, the presence or absence of the closed path setting error is determined again in step S2.

Here, since the setting errors in the second unit 303*a* and the second unit 303*b* have been corrected, there is no second unit in which the setting pipe is <c> or <d>, and the refrigerant does not flow to the second unit 303*c* and second unit 303*d* and TICI greater than or equal to Tai establishes, and it is determined that a closed path setting error is present. Therefore, the first search is performed again in step S3. In this case, since the connected pipes "c" and "d" are not set, the two opening/closing valves are forcibly operated sequentially one by one from the special control unit 125.

That is, the opening/closing valve (c) of the pipe "c" is set for the cooling flow path, and it is determined by the determination unit 126 whether a low temperature refrigerant flow is present (TICI<Tai) in the second unit 303*c* and the second unit 303*d*. Then, since a low temperature refrigerant flow is present in the second unit 303*c*, it is understood that the second unit 303*c* is connected to the connected pipe "c". Next, the opening/closing valve (d) of the connected pipe "d" is forcibly set to the cooling flow path, and it is determined whether a low temperature refrigerant flow is present in the second unit 303*d*. Then, since it is determined that a low temperature refrigerant flow is present in the second unit 303*d*, it is understood that the second unit 303*d* is connected to the connected pipe "d". After the completion of determination, the forcibly operated state is removed and the process proceeds to step S4.

Correction of connection information is performed in step S4, and the point where closed path setting error is present is corrected as shown in FIG. 11 from the state after the correction of connection information (first time) to the state after the correction of connection information (second time). After the correction of connection information (second time), the correspondence relations between the connected pipes and the setting pipes agree, and in this state no setting error is present. Thereafter, operation is continued for a predetermined time period, and it is determined that the closed path setting error is absent in step S2 again. Thereafter, the second search is performed in step S5, and it is determined in step S6 that no open path setting error is present and the cooling operation setting error detection operation is completed.

As shown in FIG. 11, there may be cases where even after it is determined that a closed path setting error is present and the points of closed path setting error are corrected, it is again determined that a closed path setting error is present. Even if the second search of step S5 is performed with a state in which the setting pipe state is that of after the correction of the first search (first time), since the setting pipe is erroneously set to the closed path pipe for the second unit 303*c* and the second unit 303*d*. Therefore, the state is such a state in which no refrigerant flow is present.

Therefore, in the second unit 303*c* and the second unit 303*d*, irrespective of the operation of the opening/closing valves for the connected pipes "a", "b", "e", and "f", TICI greater than or equal to Tai always establishes (that is, it is determined that the flow path is not the cooling flow path in all the time), and it is not possible to appropriately detect the points of setting error. Further, when the opening/closing valve (a) of the connected pipe "a" is switched to the cooling flow path from the heating flow path, since TICI greater than or equal to Tai always establishes in the second unit 303*c* and the second unit 303*d*, the low-pressure refrigerant does not flow to second units other than the second unit 303*b*. There is a possibility that the low-pressure side pressure becomes extremely low, and the operation is stopped in the midway thereof. Therefore, it is necessary to repeat the first search until it is determined that no closed path setting error is present.

<Heating Setting Pipe Setting Error Detection Operation>

FIG. 12 is a flowchart showing a heating setting pipe setting error detection operation of the air-conditioning apparatus 100 in Embodiment 1 of the present invention.

Next, the heating setting pipe setting error detection operation will be described by using a flowchart. When the heating setting pipe setting error detection operation is started, all the second units 303*a*-303*d* are turned to heating ON in step S21, and the heating only operation mode is initiated.

After continuing the operation for a predetermined time (for example, 10 minutes), it is determined in step S22 whether the degrees of supercooling at the second heat exchangers 12*a*-12*d* are predetermined values (preset values) or higher in the second units 303*a*-303*d*. The degrees of supercooling at the second heat exchangers 12*a*-12*d* are computed by the same method as described in the explanations for the refrigerant flow in the heating only operation modes by subtracting the saturation temperature at the pressure detected by the pressure sensor 204 from the temperatures detected in the temperature sensors 207*a*-207*d*.

Here, where the outdoor air temperature is such a low degree as −20 degrees C., the refrigerant discharged from the compressor 1 is cooled and condenses in the high-pressure pipe 6. Therefore, it takes a time for the refrigerant to move to the second heat exchangers 12*a*-12*d* from the start of the operation. Then, when the high-pressure side pressure does not become high unless the refrigerant moves to the second heat exchangers 12*a*-12*d*, and the detection temperature TICI does not become high. Therefore, the temperature difference between the detection temperature TICI and the detection temperature Tai becomes small. Therefore, it becomes not possible to accurately determine presence or absence of the closed path setting error (TICI greater than or equal to Tai) in step S27.

Therefore, it is determined by the determination unit 126 whether the degrees of supercooling at the second heat exchangers 12*a*-12*d* are predetermined values or greater (for example, 2 degrees C. or more), so that it is possible to confirm that the refrigerant has moved to the second units 303*a*-303*d*.

Even if the second heat exchangers 12*a*-12*d* are erroneously set to the closed path pipe and the refrigerant does not flow to the second heat exchangers 12*a*-12*d*, the liquid sides of the second heat exchangers 12*a*-12*d* substantially become the room air temperatures, the detection temperature of the temperature sensor 207 becomes lower than the saturation temperature at the pressure detected by the pressure sensor 204, the degrees of supercooling at the second heat exchangers 12*a*-12*d* become predetermined values or greater. With this configuration, even in the case where the outdoor air temperature is low, and it is possible to accurately detect the closed path setting error.

When it is determined in step S22 that the degrees of supercooling at the second heat exchangers 12*a*-12*d* are predetermined values or greater, then, presence or absence of the closed path setting error is determined in step S23. The presence or absence of the closed path setting error is determined based on the relationship between the detection temperature TICI of the temperature sensors 207*a*-207*d* and the detection temperature Tai of the temperature sensors 209*a*-209*d*.

Where the opening/closing valve a-d is set for the heating flow, and the high-temperature gas refrigerant flows to the second units 303*a*-303*d*, the detection temperature TICI of the temperature sensor 207*a* that is the piping temperatures of the liquid sides of the second heat exchangers 12*a*-12*d*, become higher than the detection temperatures Tai of the temperature sensors 209*a*-209*d* that are the indoor air temperatures.

Therefore, where TICI>Tai establishes in all the second units 303*a*-303*d*, it is determined that the high-temperature refrigerant is flowing in all the second units 303*a*-303*d* and no closed path setting error of a setting pipe is present. If there is any second unit where TICI less than or equal to Tai, it is determined by the determination unit 126 that a closed path setting error is present with a second unit in which the high-temperature refrigerant is not flowing being set. Where it is determined that there is a second unit in which TICI less than or equal to Tai establishes and a closed path setting error is present, it is determined in step S24 by the determination unit 126 whether the opening degree of the use side pressure-reducing mechanisms is the maximal opening degree in second unit in which a closed path setting error is determined to be present.

That is, since the high-pressure side pressure is difficult to rise when the room air temperature is at a low temperature such as 10 degrees C., when determining presence or absence of the closed path setting error in step S23, refrigerant flow rates in the second heat exchangers 12*a*-12*d* become small when the opening degrees of the use side pressure-reducing mechanisms 14*a*-14*d* are small. Then, detection temperatures of the temperature sensors 207*a*-207*d* that are temperatures of the liquid sides of the second heat exchangers 12*a*-12*d* decline, the temperature difference from the detection temperatures of the temperature sensors 209*a*-209*d* that are room air temperatures become small, and it becomes not possible to accurately determine presence or absence of the closed path setting error in step S27.

Therefore, there is a wait until the use side pressure-reducing mechanisms open for the second units with a closed path setting error. That is, in the second unit for which the closed path setting error is determined to be present, where the opening degrees of use side pressure-reducing mechanisms 14*a*-14*d* are the maximal opening degrees that are the upper limits of the opening degree in control, the process returns to step S22, while the process proceeds to step S25 if the opening degrees are the maximal opening degrees. With this configuration, it is possible to accurately detect the closed path setting error.

The following descriptions are directed to the heating setting pipe setting error detection operation referring specifically to example 1 of the setting error of a setting pipe as shown in FIG. 4. After passage of the step S22, since the second unit 303*a* and second unit 303*b* are erroneously set to the closed path pipes "f" and "e" in step S23 in second unit 303*a* and second unit 303*b* and the process proceeds to step S24, it is determined that a closed path setting error is present. In a second unit with a closed path setting error in step S24, the first search is performed in step S25 after it is determined that the use side pressure-reducing mechanisms 14*a*-14*d* are set for the maximal opening degrees. In the first search, the opening/closing valve of a pipe that is not set for any of the second units 303*a*-303*d* is forcibly operated, and the pipes "a" and "b" are the target of operation in the case of FIG. 4.

First, the opening/closing valve (a) of the pipe "a" is set for the heating flow path, and it is determined by the determination unit 126 whether a high-temperature refrigerant flow is present (TICI>Tai) in the second unit 303*a* and second unit 303*b*. Here, since a high-temperature refrigerant flow is determined to be present in the second unit 303*a*, it is understood that the second unit 303*a* is connected to the connected pipe "a". Next, the opening/closing valve (b) of the piping connected pipe "b" is forcibly set to the heating flow path, and it is determined whether a high-temperature refrigerant flow is present in the second unit 303*b*. After the completion of determination, the forcibly operated state is removed and the process proceeds to step S26. The first search is performed in the manner described above.

The correction of connection information is performed in step S26, and the points of closed path setting errors are corrected in the manner as shown in FIG. 6 from the state at the start of the detection operation to the state after the correction of connection information. Thereafter, operation is continued for a predetermined time period, and it is confirmed in step S22 that the degrees of supercooling at the second heat exchangers 12*a*-12*d* are predetermined values or greater, and then presence or absence of the closed path setting error is determined again in step S22. Due to the above correction, it is determined that a low temperature refrigerant is flowing in all the second units 303*a*-303*d* and no closed path setting error of a setting pipe is present, the process proceeds to step S27 and the second search is performed.

In the second search, an opening/closing valve of a pipe set for the second units 303*a*-303*d* are forcibly operated. The opening/closing valve of a pipe that is the operation target is forcibly operated from the heating flow path to the cooling flow path. For example, when the opening/closing valve (a) is switched from the heating flow path to the cooling flow path, the refrigerant flow changes from the state of the heating only operation modes in the following manner.

The refrigerant having flowed in the gas-liquid separator 7, passes through the pipe 8 and the opening/closing valves 10*b*-10*d*, flows in the gas pipe 11*b*-11*d*, and then enters the second heat exchangers 12*b*-12*d*. In the second heat exchangers 12*b*-12*d*, the refrigerant heats the indoor air delivered by the second fans 13*b*-13*d* and becomes a high pressure liquid refrigerant. The refrigerant is thereafter subjected to pressure reduction at the use side pressure-reducing mechanisms 14*b*-14*d*, passes through the liquid pipes 15*b*-15*d*, check valves 16-16*d* and the high-pressure side of the supercooling heat exchanger 21, and then divided into a refrigerant flowing in the pressure-reducing mechanism 22 and the refrigerant flowing through the check valve 17*a*.

The refrigerant having flowed in the pressure-reducing mechanism 22 is subjected to pressure reduction, heated by the high-pressure refrigerant at the low-pressure side of the supercooling heat exchanger 21, and merges with the refrigerant having flowed in the check valve 17*a* via the supercooling heat exchanger 19 and the pipe 23. On the other hand, the refrigerant having flowed to the check valve 17*a* passes through the liquid pipe 15*a* and is subjected to pressure reduction at the use side pressure-reducing mechanisms 14*a*, absorbs heat from the indoor air to become low-pressure gas refrigerant at the second heat exchanger 12*a*. Thereafter, the refrigerant passes through the gas pipe 11*a* and the opening/closing valve 9*a*, and merges with the refrigerant having flowed through the pressure-reducing mechanism 22. Other refrigerant flow is same as in the heating only operation modes.

By setting the opening/closing valve (a) for the cooling flow path, that state in the heating flow path in the second unit 303*a* in which the high-temperature gas refrigerant was flowing is changed to the state in which cool two-phase gas-liquid refrigerant flows. That is, in the heating flow path, the detection temperature TICI of the temperature sensor 207*a* that is the piping temperature at the liquid side of the second heat exchanger second heat exchanger 12*a* has been higher than detection temperature Tai of the temperature sensor 209*a* that is the indoor air temperature (TICI>Tai). However, by changing to the cooling flow path, the detection temperature becomes TICI less than or equal to Tai according to which it is assumed that the high-temperature gas refrigerant is not flowing.

In this way, a second unit in which TICI less than or equal to Tai establishes when the opening/closing valve is forcibly operated is determined by the determination unit 126. When the correspondence relation between the setting pipe of second unit in which TICI is less than or equal to Tai and the connected pipe in which the opening/closing valve is forcibly operated agrees, it is determined that the setting pipe appropriateness is achieved in the second unit, and it is determined that the open path setting error is present by the determination unit 126. With the above configuration, setting pipe appropriateness is achieved in the second unit 303*a* and the second unit 303*b*, and an open path setting error is present in the second unit 303*c* and the second unit 303*d*.

When all the opening/closing valves of a pipe that is the operation target are operated, then in step S28 presence or absence of the open path setting error is determined. Since open path setting errors have been present in the second unit 303*c* and second unit 303*d*, second search correction is performed in step S29, and the points where setting errors of the setting pipes are present are corrected from the state after the second search correction to the state after the open path branching port search correction as shown in FIG. 6. In the state after the second search correction, the connected pipes and the setting pipes agree and no setting error is present. Thereafter, operation is continued for a predetermined time period, by way of step S22, and it is determined again in step S23 that there is no closed path setting error. Thereafter, second search is performed in step S27, and it is determined that no open path setting error is present in step S28, and the heating setting pipe setting error detection operation is completed.

As described above, in the setting pipe setting error detection operation, by using the cooling operation setting error detection operation and the heating setting pipe setting error detection operation separately depending on the outdoor air temperature, it is possible to appropriately perform setting pipe setting error detection operation under a wide range of environmental temperatures. Therefore, it is possible to automatically determine whether the setting pipe is appropriate.

In Embodiment 1, the explanation was given of the state where the branching unit 302 is provided. However, the configuration of the air-conditioning apparatus is not limited to this, but the first unit 301 may be provided with branching ports 50*a*-50*f* for a plurality of branched pipes and branching ports 51*a*-51*f* for a plurality of branched pipes.

Embodiment 2

The apparatus configuration and the refrigerant circuit configuration in Embodiment 2 are the same as those in Embodiment 1. The point of difference from Embodiment 1 is that the setting pipe of second unit is distinguished from wiring of the transmission line.

FIG. 10 is a diagram showing the apparatus configuration and the wiring and connection of the transmission lines of the air-conditioning apparatus 200 of Embodiment 2 of the present invention.

In Embodiment 2, the setting pipe is determined on the basis of the relationship of connection between the second terminal supports 53*a*-53*d* of the second units 303*a*-303*d* and the first terminal supports 52*a*-52*f* of the branching unit 302.

For example, in FIG. 13, the second terminal support 53*a* of the second unit 303*a* is connected to the first wiring terminal support 52*a* via the transmission line (shown as a dashed line in the drawing), the setting pipe is <a>. The second unit 303*a*, is connected to the pipe "a" so that the correspondence relation agrees. Here, if the second unit 303*a* is erroneously connected to the first terminal support 52*f*, not the first wiring terminal support 52*a*, the setting pipe of the second unit 303*a* is <f>, and there is an incorrect correspondence relation. Even in such a case, by performing an operation that is the same as Embodiment 1, the disagreement in the correspondence relations between the connected pipes and the setting pipes are detected and points of errors in wiring connection can appropriately be displayed. As described above, it is possible to apply the technique of the present application regardless of the method for setting the branching port.

The invention claimed is:

1. An air-conditioning apparatus comprising:

a first unit including a compressor and a first heat exchanger;

a plurality of second units each including a second heat exchanger and each being connected to the first unit via a plurality of branched pipes;

a plurality of valves configured to open to permit, and close to not permit refrigerant to flow through the plurality of valves;

a electronic memory configured to store connection information set to indicate a relationship of connection between the plurality of branched pipes and the plurality of second units; and a controller configured to detect whether a closed path pipe, which is any of the plurality of branched pipes to which no second unit is actually connected, is included in the connection information as being connected to any of the plurality of second units, the controller being configured to, perform a first search by controlling one or more of the plurality of valves to search for which of the plurality of second units is actually connected to the closed path pipe in response to the connection information indicating that the closed path pipe is connected to any one of the plurality of second units.

2. The air-conditioning apparatus of claim 1, wherein the controller includes a display unit that displays a result of the first search.

3. The air-conditioning apparatus of claim 2, wherein the controller is configured to automatically correct or allow manual correction of the connection information, on a basis of a result of the first search.

4. The air-conditioning apparatus of claim 1, wherein the controller is configured to automatically correct or allow manual correction of the connection information, on a basis of a result of the first search, and when the connection information is corrected, the controller again determines whether the closed path pipe is included in the connection information.

5. The air-conditioning apparatus of claim 4, wherein the controller repeatedly performs the first search until no closed path pipe is included in the connection information.

6. The air-conditioning apparatus of claim 1, wherein in the first search, the controller controls the plurality of valves corresponding to any of the plurality of branched pipes that are not included in the connection information, sequentially one by one.

7. The air-conditioning apparatus of claim 1, wherein the controller performs a second search by controlling one or more of the plurality of valves to search for which of the plurality of valves is actually connected to which of the plurality of second units in response to the closed path pipe not being included in the connection information.

8. The air-conditioning apparatus of claim 7, wherein the controller includes a display unit that displays a result of the second search.

9. The air-conditioning apparatus of claim 8, wherein the controller is configured to automatically correct or allow manual correction of the connection information, on a basis of the result of the second search.

10. The air-conditioning apparatus of claim 7, wherein the controller is configured to automatically correct or allow manual correction of the connection information, on a basis of a result of the first search, and when the connection information is corrected, the controller again performs the second search.

11. The air-conditioning apparatus of claim 10, wherein the controller repeatedly performs the second search until the connection information becomes correct is confirmed, on a basis of the result of the second search.

12. The air-conditioning apparatus of claim 7, wherein in the second search, the controller controls the plurality of valves each corresponding to any of pipes that are not included in the connection information, sequentially one by one.

13. The air-conditioning apparatus of claim 1, further comprising an outdoor air temperature detector, wherein, before determining whether the closed path pipe is included in the connection information, the controller determines whether an outdoor air temperature detected by the outdoor air temperature detector is a preset value or greater, starts a cooling operation in all of the second heat exchangers when the outdoor air temperature is the preset value or greater, and starts a heating operation in all of the second heat exchangers when the outdoor air temperature is less than the preset value.

14. The air-conditioning apparatus of claim 13, further comprising a supercooling degree detector that detects a degree of supercooling at the second heat exchanger, wherein the controller, after the heating operation is started in all of the second heat exchangers, determines whether the degree of supercooling at the second heat exchanger, the degree of supercooling being detected by the supercooling degree detector, is a preset value or greater, and starts determination of whether the closed path pipe is included in the connection information, when the degree of supercooling at the second heat exchanger is the preset value or greater.

15. The air-conditioning apparatus of claim 14, wherein each of the plurality of second units includes a use side pressure-reducing mechanism that controls a flow rate of the refrigerant by variably setting an opening degree thereof, and the controller determines whether the opening degree of the use side pressure-reducing mechanism is a maximal opening degree when the closed path pipe is included in the connection information, and starts the first search where the opening degree of the use side pressure-reducing mechanism is the maximal opening degree.

16. The air-conditioning apparatus of claim 1, wherein the controller confirms whether a number of the plurality of second units connected to the plurality of branched pipes in the connection information and the number of second units actually connected to the plurality of branched pipes agree.

17. The air-conditioning apparatus of claim 16, wherein the controller confirms the number of the plurality of second units that are actually connected by controlling the plurality of valves to allow the refrigerant to flow in all of the plurality of branched pipes.

18. The air-conditioning apparatus of claim 1, wherein each of the plurality of second units includes a second terminal support, and a first terminal support is provided that corresponds to each of the plurality of branched pipes, and the second terminal support of each of the plurality of second units is connected via a transmission line to the first terminal support corresponding to a connected pipe to which the plurality of second units is connected.

19. An air-conditioning system comprising:

an air-conditioning apparatus including a first unit including a compressor and a first heat exchanger, a plurality of second units each including a second heat exchanger and each being connected to the first unit via a plurality of branched pipes, and a plurality of valves configured to open to permit, and close to not permit, refrigerant to flow through the plurality of valves;

electronic memory configured to store connection information set to indicate a relationship of connection between the plurality of branched pipes and the plurality of second units; and a controller configured to detect whether a closed path pipe, which is any of the plurality of branched pipes to which no second unit is actually connected is included in the connection information as a pipe connected to any of the second units, the controller being configured to perform a first search by controlling one or more of the plurality of valves to search for which of the plurality of second units is actually connected to the closed path pipe in response to the connection information indicating that the closed path pipe is connected to any one of the plurality of second units.

* * * * *